US009261832B2

(12) United States Patent
Muramatsu et al.

(10) Patent No.: US 9,261,832 B2
(45) Date of Patent: Feb. 16, 2016

(54) IMAGE HEATING APPARATUS FOR HEATING TONER IMAGE ON SHEET

(71) Applicant: CANON KABUSHIKI KAISHA, Tokyo (JP)

(72) Inventors: Hiroki Muramatsu, Tokyo (JP); Toshinori Nakayama, Kashiwa (JP); Koichi Kakubari, Toride (JP); Shigeaki Takada, Abiko (JP); Hiroto Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/341,167

(22) Filed: Jul. 25, 2014

(65) Prior Publication Data

US 2015/0037052 A1 Feb. 5, 2015

(30) Foreign Application Priority Data

Jul. 30, 2013 (JP) ..... 2013-157622

(51) Int. Cl.
*G03G 15/20* (2006.01)

(52) U.S. Cl.
CPC ..... *G03G 15/2042* (2013.01); *G03G 15/2021* (2013.01)

(58) Field of Classification Search
CPC ..... G03G 15/2042; G03G 15/2021; G03G 15/2046; G03G 15/2082
See application file for complete search history.

(56) References Cited

U.S. PATENT DOCUMENTS

| | | | | |
|---|---|---|---|---|
| 2009/0202266 | A1* | 8/2009 | Kurata et al. | 399/69 |
| 2009/0257794 | A1* | 10/2009 | Kaino et al. | 399/329 |
| 2010/0158555 | A1* | 6/2010 | Ota | 399/69 |
| 2010/0329719 | A1* | 12/2010 | Hashiguchi | 399/68 |
| 2014/0076878 | A1* | 3/2014 | Shimura | 219/216 |

FOREIGN PATENT DOCUMENTS

JP 8-152807 A 6/1996

* cited by examiner

*Primary Examiner* — Rodney Bonnette
(74) *Attorney, Agent, or Firm* — Canon USA, Inc. IP Division

(57) ABSTRACT

In an image heating apparatus including heat generating members arranged along a longitudinal direction of a belt, when an image heating operation is performed on a recording material having a width which is smaller than a maximum width of the recording material usable in the image heating apparatus, the heat generating member positioned within an area corresponding to a non passing portion of the recording material is actuated together with the heat generating member positioned within an area corresponding to a non passing portion of the recording material.

13 Claims, 15 Drawing Sheets

LARGE SIZE SHEET (A4 HORIZONTAL CONVEYANCE)

(DASHED LINE: SHAPE AT TIME OF THERMAL EXPANSION)

SMALL SIZE SHEET (A4 VERTICAL CONVEYANCE)

NON SHEET PASSING AREA – NOT HEATED

SMALL SIZE SHEET (A4 VERTICAL CONVEYANCE)

NON SHEET PASSING AREA – HEATED

IMAGE HEATING APPARATUS FOR HEATING TONER IMAGE ON SHEET

BACKGROUND OF THE INVENTION

1. Field of the Invention

The present invention relates to an image heating apparatus for heating a toner image on a sheet.

2. Description of the Related Art

An apparatus discussed in Japanese Patent Application Laid-Open No. 8-152807 uses a thermal head as a heating source of a fixing apparatus (an image heating apparatus). More specifically, the thermal head includes a number of heat generating elements which are arranged side by side along a longitudinal direction of a fixing member (a heat rotatable member). The thermal head turns on the heating elements in an area (a sheet passing portion) where a recording material (a sheet) passes through and turns off the heating elements in an area (a non sheet passing portion) where the recording material does not pass through. Thus, when such a heating mechanism is employed, in a case where image formation is performed on a recording material having a small width size, no electrical power needs to be supplied to the heating elements corresponding to the non sheet passing portion.

However, when image formation is performed on a recording material having a small width size (i.e., a small size recording material) and then the image formation is continuously performed on a recording material which is wider than the previous one (i.e., a large size recording material), there is a possibility that a temperature of the fixing member in an area which was the non sheet passing portion at the time of the image formation on the small size recording material is too low if compared with a temperature of an area which was the sheet passing portion.

Therefore, it is necessary to optimize temperature distribution in the longitudinal direction of the fixing member in a period from when the image formation on the small size recording material is finished to when the image formation on the large size recording material is started. In other words, in this case, a preparatory operation needs to be performed for selectively heating an area which was the non sheet passing portion of the fixing member.

Therefore, during the preparatory operation, the image formation on the large size recording material cannot be started.

SUMMARY OF THE INVENTION

The present invention is directed to an image heating apparatus as described below.

According to an aspect of the present invention, an image heating apparatus includes a heat rotatable member configured to heat a toner image on a sheet at a nip portion, a plurality of heating elements arranged substantially along a longitudinal direction of the heat rotatable member and configured to heat the heat rotatable member, and a controller configured to selectively actuate at least one of the plurality of the heating elements based on a width of the sheet, wherein a relevant heating element is at least one of the heating elements that is within an area corresponding to a non sheet passing area of the heat rotatable member and not within an area corresponding to a sheet passing area of the heat rotatable member, and in a case where an image heating operation is performed on a sheet having a width which is smaller than a maximum width of the sheet usable in the image heating apparatus, the controller actuates at least one of the relevant heating elements in a predetermined time period.

Further features of the present invention will become apparent from the following description of exemplary embodiments with reference to the attached drawings.

DESCRIPTION OF THE EMBODIMENTS

Various exemplary embodiments, features, and aspects of the present invention will be described in detail below with reference to the drawings.

[First Exemplary Embodiment]

[Image Forming Unit]

Figure 3:
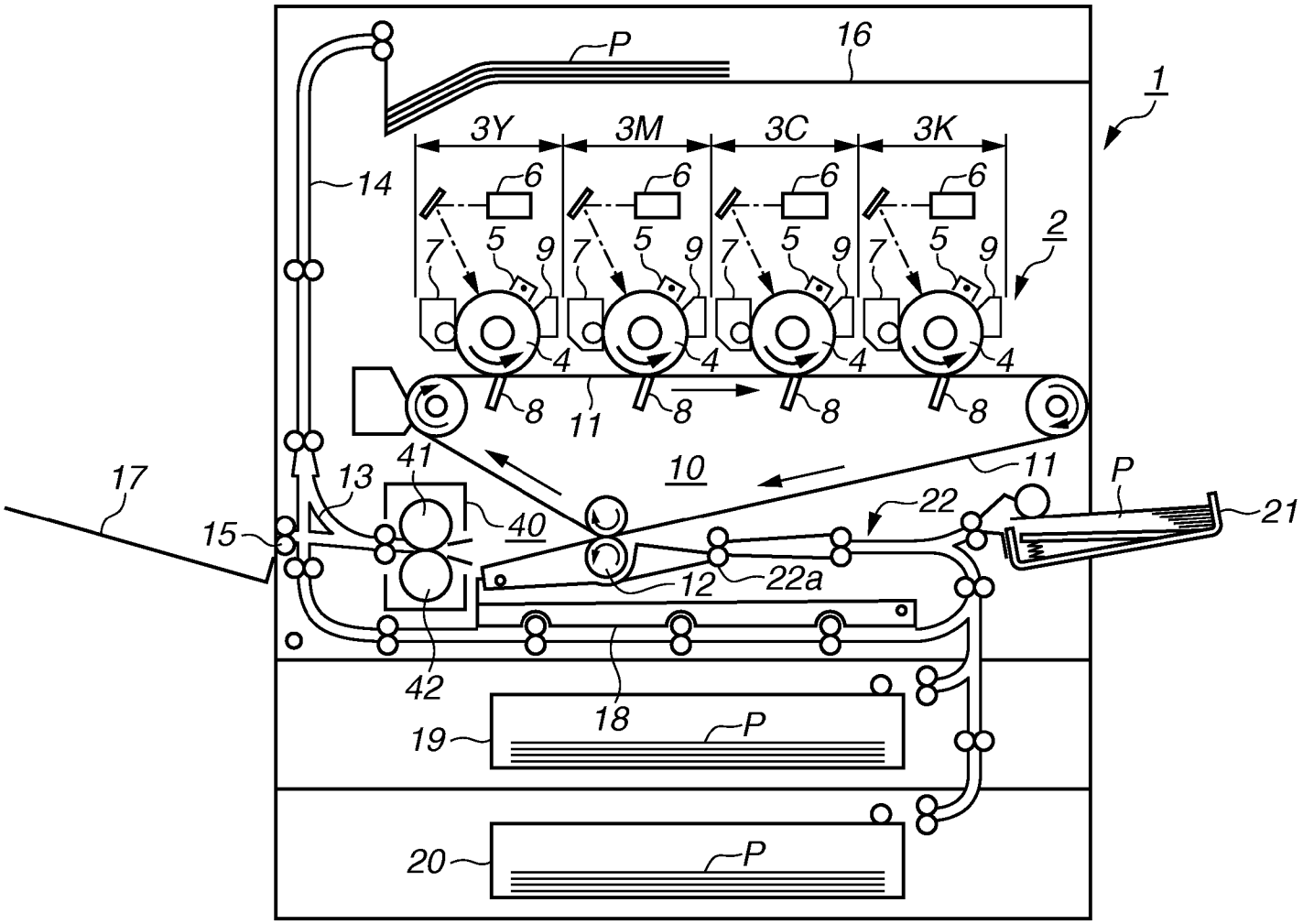
FIG. 3 is a schematic drawing illustrating a structure of an image forming apparatus according to the first exemplary embodiment.

FIG. 3 is a schematic drawing illustrating an example of a configuration of an image forming apparatus 1 which is provided with an image heating apparatus according to the present invention as a fixing apparatus for heating and fixing an unfixed image. The image forming apparatus 1 is a color printer which can form a toner image corresponding to image information to be input from a host apparatus 23 (in FIG. 1) to a control unit (a control circuit unit) 24 on a recording material (a sheet) P using the electrophotographic technology.

A recording material (a sheet) is a member to be used by the image forming apparatus to form a toner image thereon, and includes, for example, standard or non-standard plain paper, thick paper, an envelope, a postcard, a seal, a resin sheet, an over head projector (OHP) sheet, and glossy paper.

An image forming unit 2 includes four image forming station 3Y, 3M, 3C, and 3K for forming an image on a recording material P. A recording material P is fed from a sheet feeding cassette 19 or 20 or a manual sheet feeding tray (a multi sheet feeding tray) 21, and conveyed by a conveyance mechanism 22 including a registration roller pair 22*a*.

Each of the image forming stations includes a rotary drum type photosensitive member 4 serving as an image bearing member, a charging member 5, a laser scanner 6, a development device 7, a primary charging blade 8, and a photosensitive member cleaner 9. The image forming stations 3Y, 3M, 3C, and 3K respectively form a toner image in yellow (Y), magenta (M), cyan (C), and black (K).

The image forming unit 2 further includes an intermediate transfer unit 10, and composed toner images which are formed by overlapping toner images of respective colors and primary transferred from the image forming stations 3Y, 3M, 3C, and 3K to an intermediate transfer belt 11 are secondarily transferred all together to a recording material P by a secondary transfer roller 12. The registration roller pair 22*a* once receives a leading edge of the recording material P, and straightens the recording material P if it skews. Then, the registration roller pair 22*a* sends the recording material P to a nip between the intermediate transfer belt 11 and the secondary transfer roller 12 by synchronizing the toner image on the intermediate transfer belt 11. Since the above-described operations of the image forming unit 2 and color image forming processes are known techniques, the detail description thereof is omitted.

The recording material P on which an unfixed toner image is secondarily transferred in the image forming unit 2 is conveyed to a fixing apparatus 40, and the toner image is heated and pressed to fix as a fixed image. A path of the recording material P output from the fixing apparatus 40 is switched by a flapper 13 to a first path 14 or a second path 15 according to a predetermined mode selection. The recording material P guided to the first path 14 is discharged to a face-down tray 16 on an upper side of the apparatus. The recording material P guided to the second path 15 is discharged to a faceup tray 17 on a side of the apparatus.

In the case of a two-sided image formation mode, the recording material P which is output from the fixing apparatus 40 and subjected to the image formation on its first side is once guided into the first path 14 and then guided to a third path 18 by switchback conveyance. Further, the recording material P is conveyed again to the image forming unit 2 via the conveyance mechanism 22 in a state that a front and a back thereof are reversed.

[Fixing Apparatus]

(1) General Description of an Apparatus Configuration

Figure 1:
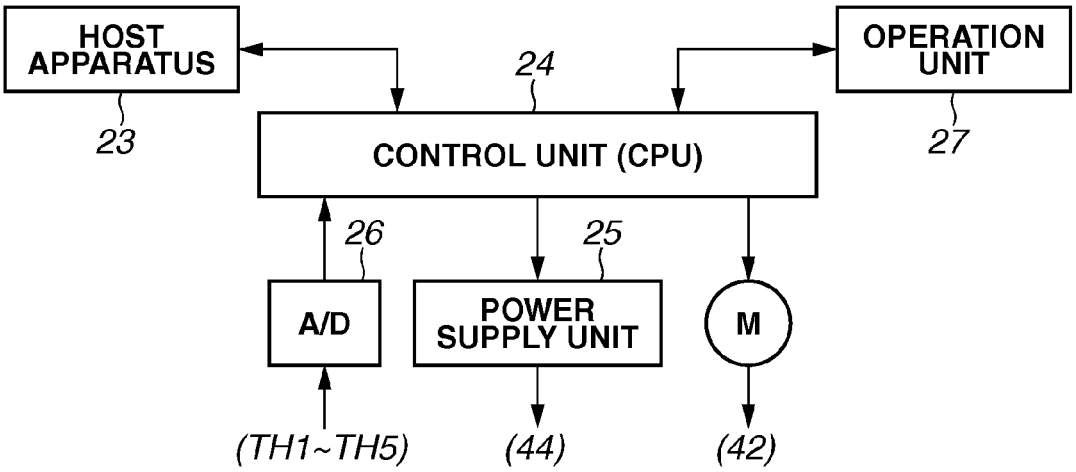
FIG. 1 is a schematic drawing, which is an enlarged cross section viewed from a right side, of a main part and a block diagram of a controlling system of a fixing apparatus according to a first exemplary embodiment.
Figure 1:
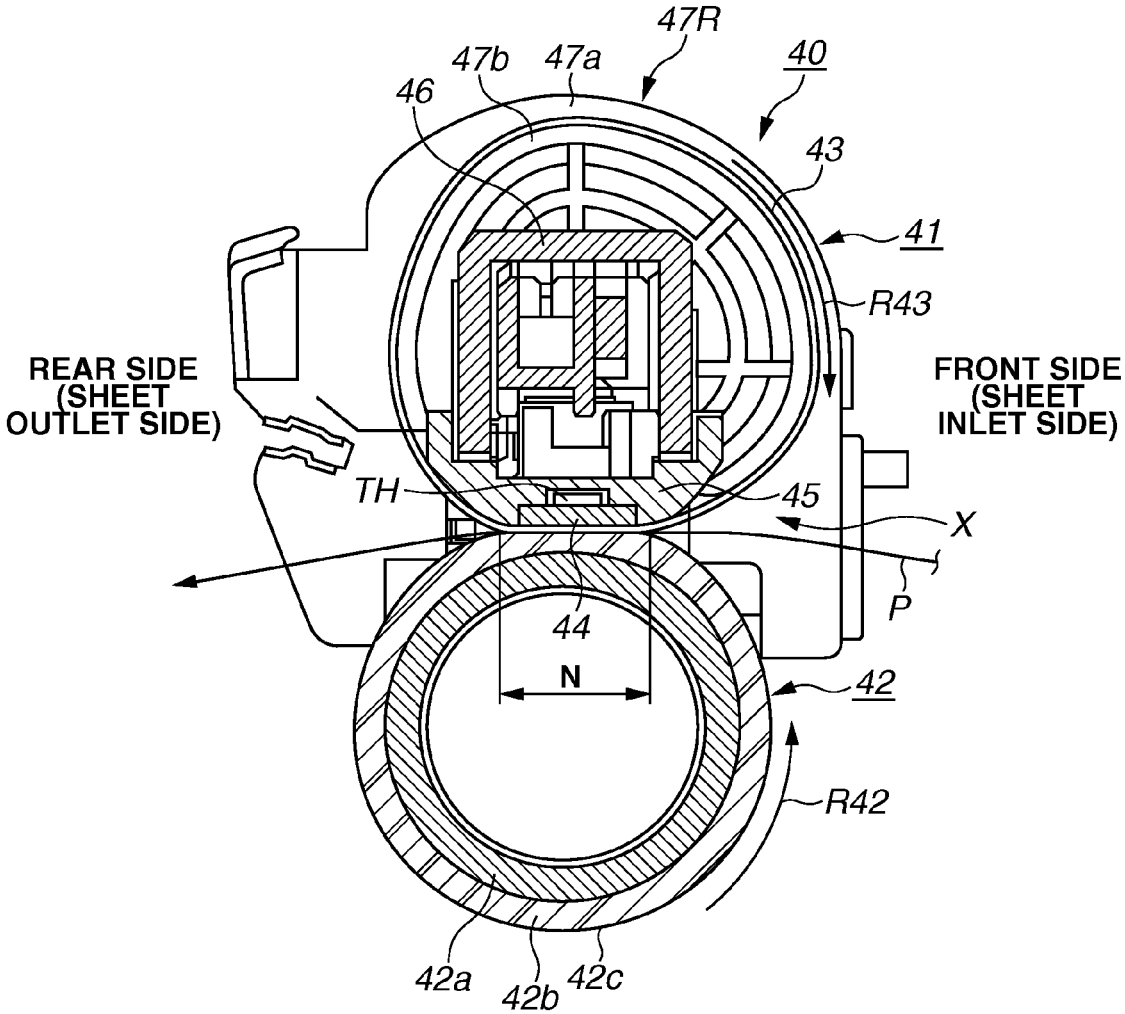
Figure 2A:
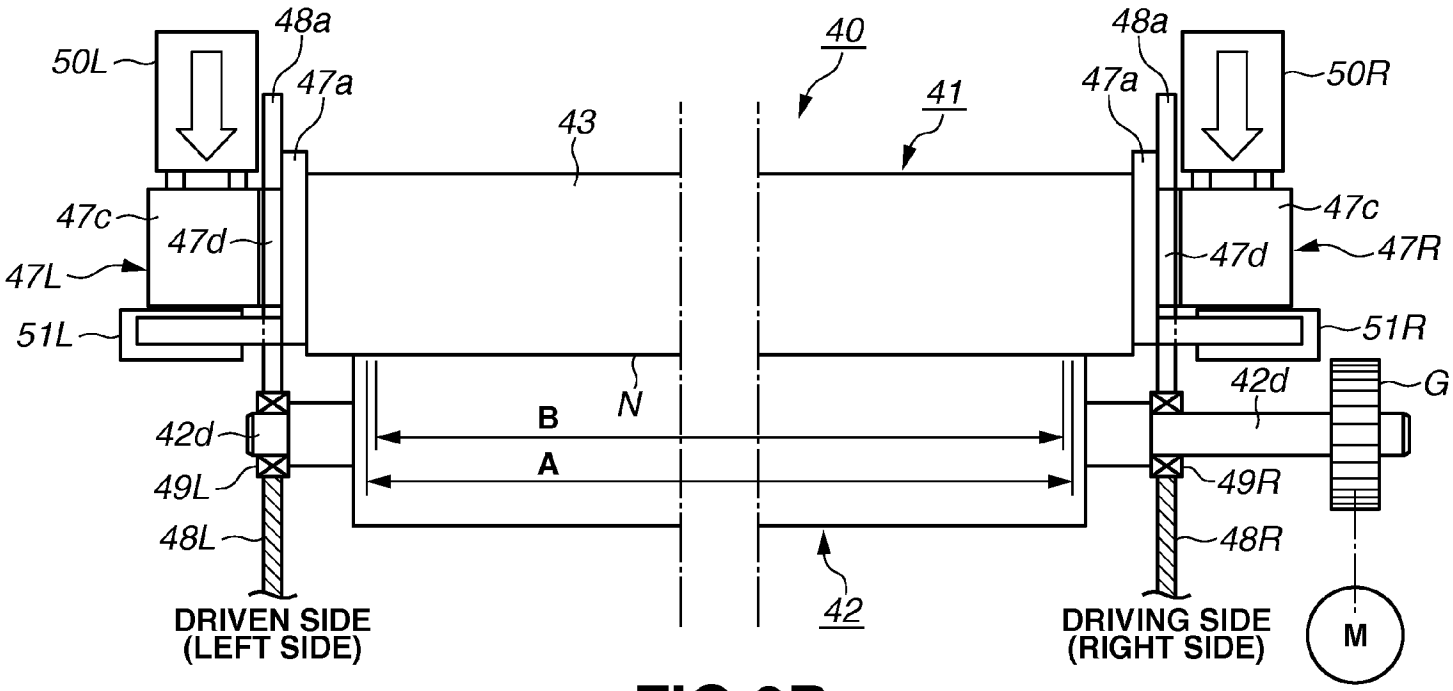
FIG. 2A is a front schematic drawing illustrating the main part of the fixing apparatus, which is partially omitted.

FIG. 1 is a schematic drawing, which is an enlarged cross section viewed from the right side, of a main part and a block diagram of a controlling system of the fixing apparatus 40 according to the first exemplary embodiment. FIG. 2A is a front schematic drawing illustrating the main part of the fixing apparatus, which is partially omitted.

In this description, regarding the fixing apparatus 40 or structural members thereof according to the first exemplary embodiment, a front side means a surface viewed the fixing apparatus 40 from a recording material inlet side, and a rear side means a surface opposite to the front side (a recording material outlet side). Left and right mean a left side (one end side) and a right side (another end side) of the fixing apparatus 40 viewed from the front side. In the fixing apparatus 40 according to the first exemplary embodiment, the right side and the left side thereof are referred to as a driving side and a driven side, respectively.

In addition, an upstream and a downstream mean an upstream and a downstream in a recording material conveyance direction X. A longitudinal direction (a width direction) and a recording material width direction are substantially parallel to a direction perpendicular to the conveyance direction X of the recording material P on a recording material conveyance path surface. A lateral direction is substantially parallel to the conveyance direction X of the recording material P on the recording material conveyance path surface.

The fixing apparatus 40 according to the first exemplary embodiment is a tensionless type on-demand fixing apparatus adopting a belt (film) heating system and a horizontally long apparatus of which right and left direction is the longitudinal direction. The fixing apparatus 40 is mainly provided with a belt unit 41 including an endless belt (a heat rotatable member) 43 having flexibility as a heat rotatable member and a pressure roller (an elastic roller) 42 having heat resistance and elasticity as a pressing rotatable member.

The belt unit 41 is constructed by assembling the endless belt 43, a heater 44 as a heating member (a heating source), a heater holder 45 as a holding member for fixing and holding the heater 44, a pressing stay 46, terminal members (fixing flanges) 47L and 47R on the left and right end sides, and so on.

Figure 2B:
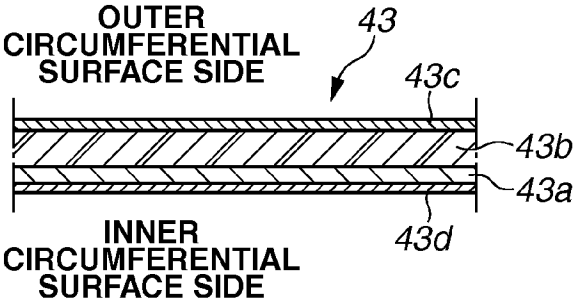
FIG. 2B is a schematic drawing illustrating a layer composition of a belt.

The belt 43 is a member for transferring heat to a recording material P and has a cylindrical shape (cylindrical and endless) which is long in the right and left direction and flexible as a whole. FIG. 2B is a schematic drawing illustrating a layer composition of the belt 43 according to the first exemplary embodiment. The belt 43 has a four layer composite structure including a cylindrical base material layer 43*a*, an elastic layer 43*b* formed on an outer circumferential surface of the base material layer 43*a*, a releasing layer 43*c* as a surface layer formed on an outer circumferential surface of the elastic layer 43*b*, and an inner surface coating layer 43*d* formed on an inner circumferential surface of the base material layer 43*a*.

For the base material layer 43*a*, a heat resistance material with a thickness of 100 μm or less, preferably not less than 20 μm and not more than 50 μm can be employed to improve a quick startability. For example, a metal belt made of stainless steel (SUS) and nickel can be used. According to the first exemplary embodiment, a cylindrical nickel metal belt with a thickness of 30 μm and 25 mm in diameter is used.

For the elastic layer 43*b*, a rubber material with a thickness of 1000 μm or less, preferably 500 μm or less can be employed to reduce a thermal capacity and improve a quick startability. For example, silicone rubber and fluororubber can be used. According to the first exemplary embodiment, silicone rubber having a rubber hardness of 10 degrees (according to JIS-A), heat conductivity of 1.3 W/mK, and a thickness of 300 μm is used.

For the releasing layer 43*c*, a fluororesin material with a thickness of 100 μm or less, preferably 20 to 70 μm can be used. For example, polytetrafluoroethylene (PTFE), fluorinated ethylene-propylene copolymer (FEP), and tetrafluoroethylene-perfluoroalkyl vinyl ether copolymer can be used for a fluororesin layer. According to the first exemplary embodiment, a PFA tube with a thickness of 30 μm is used.

For the inner surface coating layer 43*d*, a resin layer having heat resistance can be used since the inner surface coating layer 43*d* is in contact with the heater 44. For example, an engineering plastic can be used. More specifically, polyimide, polyimidoamide, polyether ether ketone (PEEK), and polytetrafluoroethylene resin (PTFE) can be used. Further, fluorinated ethylene-propylene copolymer (FEP) and tetrafluoroethylene-perfluoroalkyl vinyl ether copolymer (PFA) can be used. According to the first exemplary embodiment, polyimide is used as the inner surface coating layer 43*d*, and a polyimide inner surface layer with a thickness of 10 μm is formed by applying a varnish-like raw material solution on a base material and firing after forming a color development layer.

All of the heater 44, the heater holder 45, and the pressing stay 46 are long in the right and left direction. The belt 43 is externally fitted to the assembly of the heater holder 45, which fixes and holds the heater 44, and the pressing stay 46 loosely. The terminal members 47L and 47R are installed in one and the other end portions of the pressing stay 46 at one and the other end sides of the belt 43.

The heater 44 is a ceramic heater according to the first exemplary embodiment. The heater 44 includes a slender thin plate shape substrate (a ceramic substrate) and the heat generating members (an energization heating resistor layer) which generate heat by energization and are provided on the substrate surface as a basic configuration thereof, and is a low thermal capacity heater of which temperature will rise with a steep rising characteristic by the energization to the heat generating member. The specific configuration of the heater 44 is described in detail below in the paragraph (3).

The heater holder 45 is a molded product made of a heat-resistant resin and has a groove for fitting the heater thereinto which is formed on a center portion of the outer surface along the longitudinal direction. The heater 44 is fit into the groove, so that the heater is fixed and held therein. The heater holder 45 holds the heater 44 and also functions as a rotation guide member (a backup member) of the belt 43 which is externally fitted to the heater holder 45 and the pressing stay 46.

The pressing stay 46 is a member having rigidity which gives strength to the heater holder 45 in the longitudinal direction by being pressed against a back surface of the heater holder 45 made of resin and also cures the heater holder 45. According to the first exemplary embodiment, the pressing stay 46 is a metal mold material having a downward facing U-shaped or C-shaped cross section.

Each of the terminal members 47L and 47R is the heat-resistant resin molded product having a bilaterally symmetric shape which plays a role of regulating a movement of the belt 43 (a thrust movement) along the longitudinal direction of the heater holder at the time of rotation and regulating a shape in a belt circumferential direction by guiding an inner circumferential surface of a belt end portion.

More specifically, each of the terminal members 47L and 47R includes a flange seat 47*a* for receiving a belt end surface which serves as a first regulation unit for regulating the thrust movement of the belt 43. Further, each of the terminal members 47L and 47R includes an inner surface guiding unit 47*b* serving as a second regulation unit for guiding an inner surface of the belt end portion by internally fitting into the belt end portion. When the belt 43 is rotated by following rotation of the pressure roller 42 as a driving rotation member, a cross section of the belt 43 will be a substantially elliptical shape. The inner surface guiding unit 47*b* guides the inner surface of the belt end portion so that the belt 43 can maintain the substantially elliptical shape.

The pressure roller 42 is an elastic roller having a composite layer configuration which includes a cored bar (a roller base member: pipe material) 42*a* made of SUS, iron, or the like, an elastic member layer 42*b* formed in a roller shape around the cored bar integrally and concentrically, and a releasing layer (a surface layer) 42*c* covering an outer circumferential surface of the elastic member layer 42*b*. The elastic member layer 42*b* is made of heat-resistant rubber, such as silicone rubber and fluororubber, or a silicone rubber foam.

An outer diameter of the pressure roller 42 according to the first exemplary embodiment is 30 mm since the roller shaped SUS cored bar 42*a* of 20 mm in outer diameter is provided with a silicone rubber layer 42*b* with a thickness of 5 mm and a coefficient of cubic expansion of $1.05*10^{-3}$° C.$^{-1}$. The pressure roller 42 is installed in a manner that respective left and right end sides of a rotation center axis 42*d* thereof are rotatably held between side plates 48L and 48R on the left and the right of a frame member of the fixing apparatus via bearing members (bearings) 49L and 49R.

A drive gear G is installed integrally and concentrically on the right side, which is a driving side, of the rotation center axis 42*d*. To the drive gear G, a driving force of a driving unit (a motor) M controlled by the control unit 24 is transmitted via a power transmission mechanism (not illustrated). Accordingly, the pressure roller 42 can be rotationally driven as a driving rotation member at a predetermined circumferential speed in a counterclockwise direction shown by an arrow R42 in FIG. 1.

On the other hand, the belt unit 41 is arranged substantially parallel to the pressure roller 42 between the side plates 48L and 48R on the left and the right above the pressure roller 42 in a state that a heater arrangement unit side of the heater holder 45 is directed downward. More specifically, guide groove portions 47*d* in a vertical direction which are provided both of the terminal members 47L and 47R on the left and the right of the belt unit 41 respectively engage with guide slits 48*a* in a vertical direction which are provided both of the side plates 48L and 48R on the left and the right sides.

According to this configuration, the respective terminal members 47L and 47R on the left and the right sides are held slidably movable in the vertical direction with respect to the side plates 48L and 48R on the left and the right sides. In other words, the belt unit 41 is held slidably movable with respect to the side plates 48L and 48R on the left and the right sides. The heater arrangement unit of the heater holder 45 in the belt unit 41 faces to the pressure roller 42 via the belt 43.

Pressure receiving units 47*c* of the terminal members 47L and 47R on the left and the right sides are pressed at a predetermined pressing force by respective pressing mechanisms 50L and 50R on the left and the right sides. In other words, the belt unit 41 is pressed at the predetermined pressing force against the pressure roller 42. Accordingly, the heater arrangement unit of the heater holder 45 and the pressure roller 42 are contact with each other across the belt 43 and pressed on each other against the elasticity of the elastic member layer 42*b*, so that a nip portion N having a predetermined width is formed between the belt 43 and the pressure roller 42 in the lateral direction.

The pressing mechanisms 50L and 50R on the left and the right sides are mechanisms including, for example, a pressure spring and a pressure cam. The heater 44 is located at a portion corresponding to the nip portion N of the heater holder 45 in the longitudinal direction of the heater. In the fixing apparatus 40 according to the first exemplary embodiment, the heater 44 and the heater holder 45 are nip forming members being in contact with an inner surface of the belt 4. In addition, the pressure roller 42 forms the nip portion N together with the nip forming members 44 and 45 via the belt 43. As described above, the heater 44 is located inside of the belt 43, and the heater 44 and the pressure roller 42 press contact with each other across the belt 43 and form the nip portion N.

(2) Fixing Operation

Fixing operations of the fixing apparatus 40 are performed as described below. The control unit 24 starts up the driving unit M at a predetermined control timing. A rotational driving force is transmitted from the driving unit M to the pressure roller 42 via a rotational drive transmission system (not illustrated). According to this operation, the pressure roller 42 is rotationally driven at a predetermined speed in the counterclockwise direction shown by the arrow R42.

When the pressure roller 42 is rotationally driven, a rotating torque acts on the belt 43 at the nip portion N by a frictional force between the pressure roller 42. Accordingly, the belt 43 is driven to rotate around an outer periphery of the heater holder 45 and the pressing stay 46 in a clockwise direction shown by an arrow R43 at a speed approximately corresponding to the speed of the pressure roller 42, while the inner surface of the belt 42 adheres and slides on a surface of the heater 44. A semi-solid lubricant is applied on the inner surface of the belt 43, so that slidability at the nip portion N between the heater 44 or an outer surface of the heater holder 45 and the inner surface of the belt 43 is secured.

As described above, the pressure roller 42 is a driving rotation member which drives the belt 43 and also forms the nip portion N in cooperation with the belt 43.

The control unit 24 starts energization to the heater 44 from a power supply unit (a power source unit) 25. The electric power from the power supply unit 25 is supplied to the heater 44 via electrical connectors 51L and 51R on one and the other end sides which are attached on left and right portions of the belt unit 41. A temperature of the heater 44 will quickly rise by the energization. The temperature rise can be detected by thermistors TH1 to TH5 disposed on a back surface side (an upper surface) of the heater 44. The thermistors TH1 to TH5 are connected to the control unit 24 via an analog-digital (A/D) converter 26. The belt 43 is heated at the nip portion N by the heat generation of the heater 44 caused by the energization.

The control unit 24 samples an output from the thermistor TH at a predetermined period and has a configuration which can reflect temperature information thus obtained on temperature control. More specifically, the control unit 24 determines contents of the temperature control of the heater 44 based on the output of the thermistor TH and controls the energization to the heater 44 by the power supply unit 25 so that a temperature of a portion corresponding to a passing portion of the heater 44 will be a target temperature (a predetermined set temperature).

In the above-described control state of the fixing apparatus 40, a recording material P bearing an unfixed toner image is conveyed from the image forming unit 2 side to the fixing apparatus 40 side and guided into the nip portion N. The heat of the heater 44 is applied to the recording material P via the belt 43 in the process in which the recording material P is nipped and conveyed in the nip portion N. The unfixed toner image is melted and fixed onto a surface of the recording material P by the heat of the heater 44 and the pressure from the nip portion N. The recording material P output from the nip portion N is curvature separated from the belt 43 and discharged and conveyed from the fixing apparatus 40. When the print operation is finished, the control unit 24 issues a fixing operation completion instruction to stop the power supply from the power supply unit 25 to the heater 44 and stop the driving unit M.

In FIG. 2A, a width A indicates a maximum heating area width of the heater 44. A width B indicates a maximum passing width of a recording material P which can pass through the fixing apparatus 40, and the width B is the same as or slightly smaller than the maximum heating area width A of the heater 44. An entire length area (i.e. a length of the pressure roller 42) of the nip portion N formed by the belt 43 and the pressure roller 42 has a slightly larger width than the maximum heating area width A of the heater 44.

In the fixing apparatus 40 according to the first exemplary embodiment, conveyance of a recording material P is performed based on a center of a recording material width which is referred to as central reference conveyance. In other words, regardless of any width size of a recording material P which can pass through the apparatus, a center portion in a width direction of the recording material P passes through a center portion in the longitudinal direction of the belt 43 (a center portion of the maximum heating area width A of the heater 44).

(3) Heater

Figure 4A:
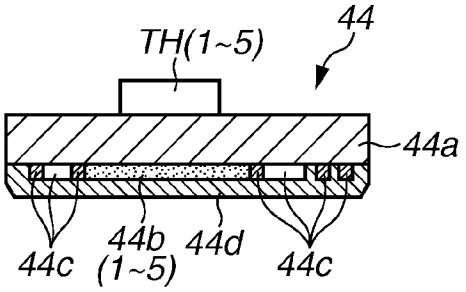
FIG. 4A is a schematic drawing illustrating an enlarged cross section of a heater.
Figure 4B:
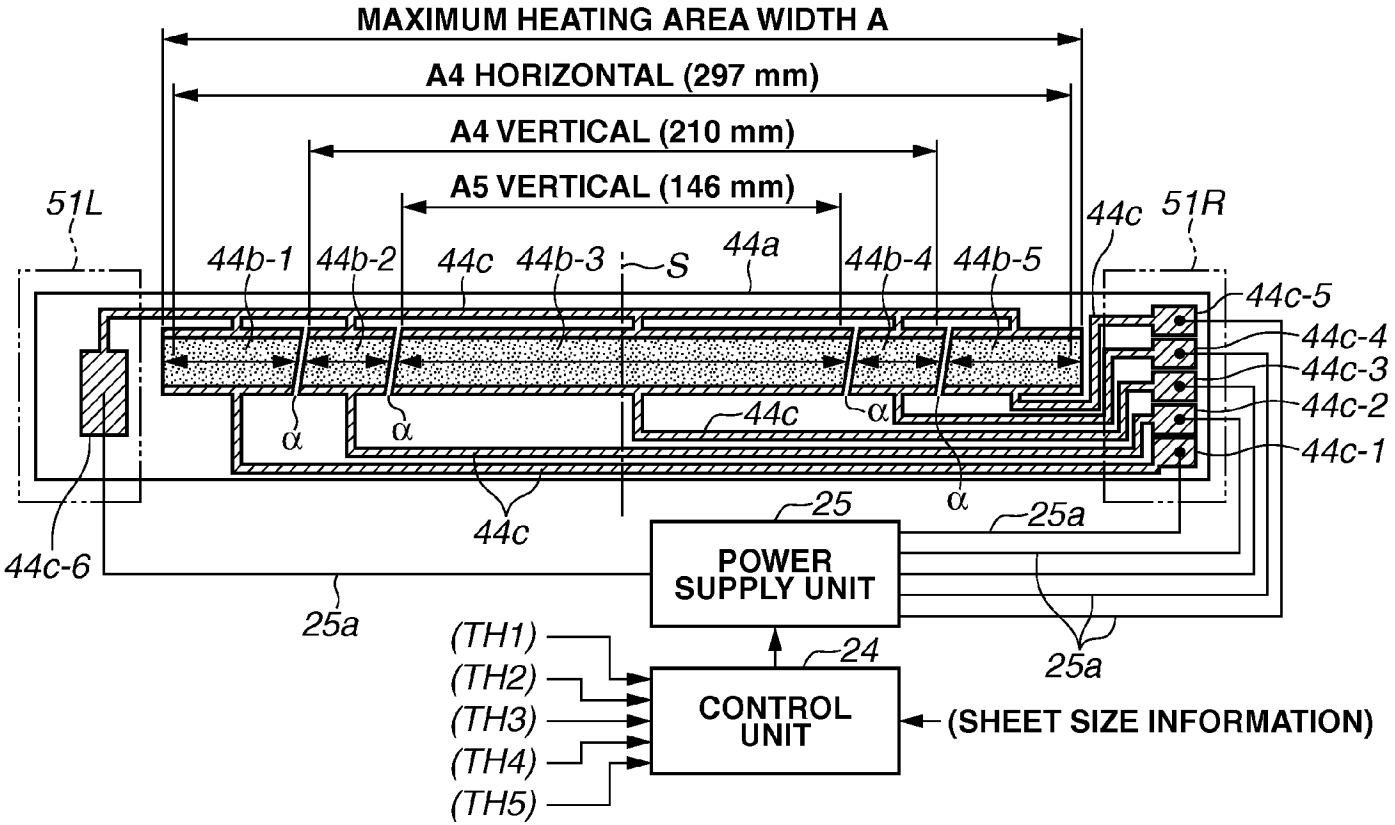
FIG. 4B is a schematic drawing illustrating heat generating members which are disposed on one side of a heater substrate and a formation pattern of power supply paths to the heat generating members.

FIG. 4A is a schematic drawing illustrating an enlarged cross section of the heater 44. FIG. 4B is a schematic drawing illustrating the heat generating members 44*b*-1 to 44*b*-5 which are disposed on one side (a front side) of the heater substrate 44*a* and a formation pattern of power supply paths 44*c* with respect to the heat generating members 44*b*-1 to 44*b*-5.

The heater 44 is a ceramic heater. The heater 44 includes the heater substrate 44*a* having a slender thin plate shape, the heat generating members 44*b*-1 to 44*b*-5 which are formed on the one side of the heater substrate 44*a* along the longitudinal direction thereof, the power supply paths 44*c* to the heat generating members 44*b*-1 to 44*b*-5, and a surface protective layer 44*d* formed thereon. The heater 44 further includes the thermistors TH1 to TH5 serving as heater temperature detection members (contact type thermometer) which are disposed on the other side (a back surface side) of the heater substrate 44*a*.

According to the first exemplary embodiment, the surface protective layer 44*d* side of the heater 44 faces to the inner side of the belt 43 at the nip portion N, and the heater 44 is held by the heater holder 45 by being fitted into the groove of the heater holder 45 with the surface protective layer 44*d* side on the outside.

The heater substrate 44*a* is made of a ceramic material, such as aluminum and aluminum nitride. The heat generating member 44*b* is a layer (a heat generation resistor layer) which is obtained in a manner that a pattern is formed with an energization heating resistor material, such as silver palladium (Ag/Pd), $Ta_2N$, and $RuO_2$, using screen printing or the like, and then fired. The power supply path 44*c* is a layer (a conductive layer) which is obtained in a manner that a pattern is formed with a conductive material, such as an Ag paste, using screen printing or the like, and then fired. The surface protective layer 44*d* is a layer (an electrical insulating layer) which is obtained in a manner that a pattern is formed with a heat resistant and electrical insulating material, such as heat resistant glass, using screen printing, and then fired.

The heat generating member 44*b* includes an aggregation (lines) of a plurality of heat generating members (i.e. a heating element: hereinbelow, referred to as an individual heat generating member) 44*b*-1, 44*b*-2, 44*b*-3, 44*b*-4, and 44*b*-5 which are arranged along the longitudinal direction of the belt 43 and generate heat by being individually energized. According to the first exemplary embodiment, as illustrated in FIG. 4B, the heat generating member 44*b* includes the aggregation of first to fifth individual heat generating members 44*b*-1, 44*b*-2, 44*b*-3, 44*b*-4, and 44*b*-5 from one to the other end sides of the longitudinal direction.

Adjacent individual heat generating members are separated from each other with an insulation gap $\alpha$ about 1 mm width. Each insulation gap α is formed diagonally to the conveyance direction X of the recording material P so as to overlap heat generation areas between each of the individual heat generating members in the recording material conveyance direction X. According to this configuration, continuity of the heat generation areas between each of the heat generating members can be secured in the conveyance direction X of the recording material.

According to the first exemplary embodiment, heat generation widths of the first to the fifth individual heat generating members 44*b*-1, 44*b*-2, 44*b*-3, 44*b*-4, and 44*b*-5 in the longitudinal direction are indicated in Table 1. The heat generation width of each individual heat generating member is a dimension in the longitudinal direction at a center portion in the lateral direction of each individual heat generating member.

TABLE 1

| individual heat generating member | First 44b-1 | Second 44b-2 | Third 44b-3 | Fourth 44b-4 | Fifth 44b-5 |
|---|---|---|---|---|---|
| heat generation width | 45 mm | 30 mm | 150 mm | 30 mm | 45 mm |

The power supply path 44*c* to the heat generating member 44*b* has an electrical path pattern which can individually control the energization and the power supply to each individual heat generating member and cause each individual heat generating member to generate heat in an entire length area of a heat generation area thereof at a predetermined controlled power. According to the first exemplary embodiment, the control unit 24 controls the power supply unit 25, and power supply and an amount of power to be supplied are individually controlled between a common electrode 44*c*-6 on one end side of the heater 44 and individual electrodes 44*c*-1 to 44*c*-5 on the other end side thereof.

The common electrode 44*c*-6 is electrically connected to the power supply unit 25 via a lead wire 25*a* and the electrical connector 51L on one end side. Further, each of the individual electrodes 44*c*-1 to 44*c*-5 is electrically connected to the power supply unit 25 via the lead wire 25*a* and the electrical connector 51L on the other end side.

More specifically, when power is supplied between the common electrode 44*c*-6 and the first individual electrode 44*c*-1, an entire length area of a heat generation area of the first individual heat generating member 44*b*-1 generates heat at a heat generation amount corresponding to the amount of power supplied. When power is supplied between the common electrode 44*c*-6 and the second individual electrode 44*c*-2, an entire length area of a heat generation area of the second individual heat generating member 44*b*-2 generates heat at a heat generation amount corresponding to the amount of power supplied. When power is supplied between the common electrode 44*c*-6 and the third individual electrode 44*c*-3, an entire length area of a heat generation area of the third individual heat generating member 44*b*-3 generates heat at a heat generation amount corresponding to the amount of power supplied.

Further, when power is supplied between the common electrode 44*c*-6 and the fourth individual electrode 44*c*-4, an entire length area of a heat generation area of the fourth individual heat generating member 44*b*-4 generates heat at a heat generation amount corresponding to the amount of power supplied. When power is supplied between the common electrode 44*c*-6 and the fifth individual electrode 44*c*-5, an entire length area of a heat generation area of the fifth individual heat generating member 44*b*-5 generates heat at a heat generation amount corresponding to the amount of power supplied.

In FIG. 4B, a line S is a center passing reference line (a virtual line) of a recording material P. The center passing reference line S substantially corresponds to a center of the heat generation width of the third individual heat generating member 44*b*-3. The heat generation width of the heat generation area of the third individual heat generating member 44*b*-3 substantially corresponds to a vertical conveyance width of an A5 size recording material (an A5 vertical size (A5R): 146 mm).

A heat generation width of a total of three heat generation areas of the second, third and fourth individual heat generating members 44*b*-2, 44*b*-3, and 44*b*-4 substantially corresponds to a vertical conveyance width of an A4 size recording material (an A4 vertical size (A4R): 210 mm). Further, a heat generation width of a total of five heat generation areas of the first to fifth individual heat generating members 44*b*-1 to 44*b*-5 substantially corresponds to a horizontal conveyance width of an A4 size recording material (an A4 horizontal size: 297 mm).

According to the first exemplary embodiment, a maximum width size (a maximum passing width) of a recording material P which can pass through (can be introduced into) the fixing apparatus 40 is the A4 horizontal size. In addition, the heat generation width of the total of five heat generation areas of the first to fifth individual heat generating members 44*b*-1 to 44*b*-5 is the maximum heating area width A of the heater 44 and substantially corresponds to the A4 horizontal size, which is the maximum width size of the recording material.

According to the first exemplary embodiment, as described below, a control configuration is provided which can selectively switch the power supply and the amount of power to be supplied to the individual heat generating member corresponding to a passing portion where a recording material P introduced to the fixing apparatus 40 passes through (i.e., a sheet passing portion) and to the individual heat generating member corresponding to a non passing portion where the recording material P does not pass through (i.e., a non sheet passing portion).

Figure 5:
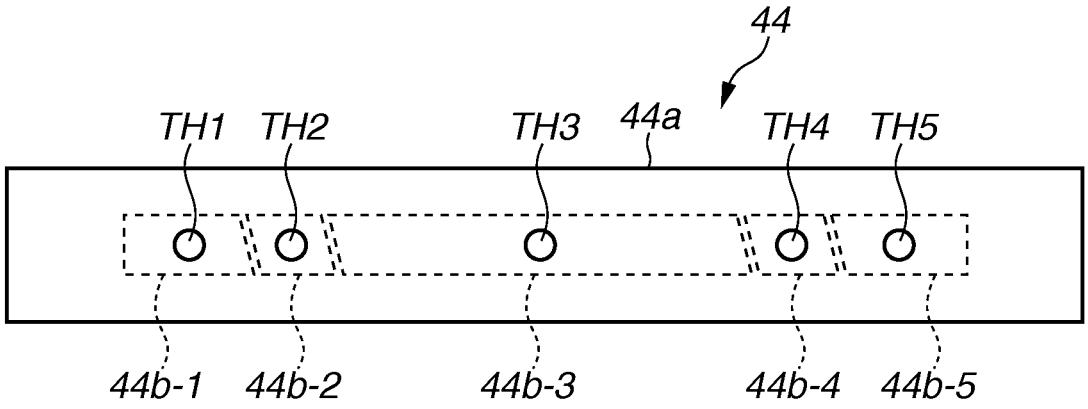
FIG. 5 is a plane schematic drawing illustrating the other side of the heater substrate.

Regarding the thermistor TH as a temperature sensor, a total of five thermistors, namely the first to fifth thermistors TH1 to TH5 are disposed on the other surface side of the heater substrate 44*a* so as to contact with the heater substrate 44*a* at positions respectively corresponding to five of the first to fifth individual heat generating members 44*b*-1 to 44*b*-5 as illustrated in FIG. 5.

Each of the first to fifth thermistors TH1 to TH5 detects a temperature at a part corresponding to the first to fifth individual heat generating members 44*b*-1 to 44*b*-5 of the heater 44, and feeds back temperature detection information (a detection result) to a temperature control unit (a temperature control function unit) of the control unit 24. The control unit 24 controls input power to each individual heat generating member based on the temperature detection information from each of the thermistors TH1 to TH5 so that each heater portion where the corresponding individual heat generating member exists becomes a target temperature.

(4) Relationship Between Belt Temperature and Rise Time

Next, experiments were conducted with respect to a relationship between a temperature of the belt 43 and a time amount required to reach the target temperature. In the present experiments, the fixing apparatus 40 as illustrated in FIGS. 1, 2A, 2B, 4A, and 4B was used. As for operation conditions, a belt rotation speed was 248 mm/s, a total pressing force was 314 N (32 kgf), and the input power to the heater 44 was 800 W which was a total of the input power to the five individual heat generating members 44b-1 to 44b-5. Further, a target temperature to be reached was 180° C. (a predetermined first temperature) which is a heater temperature detected by the thermistors TH1 to TH5 (a belt back surface temperature: hereinbelow, referred to as a belt temperature). According to the first exemplary embodiment, the belt temperature of 180° C. is an image fixing temperature.

Figure 6:
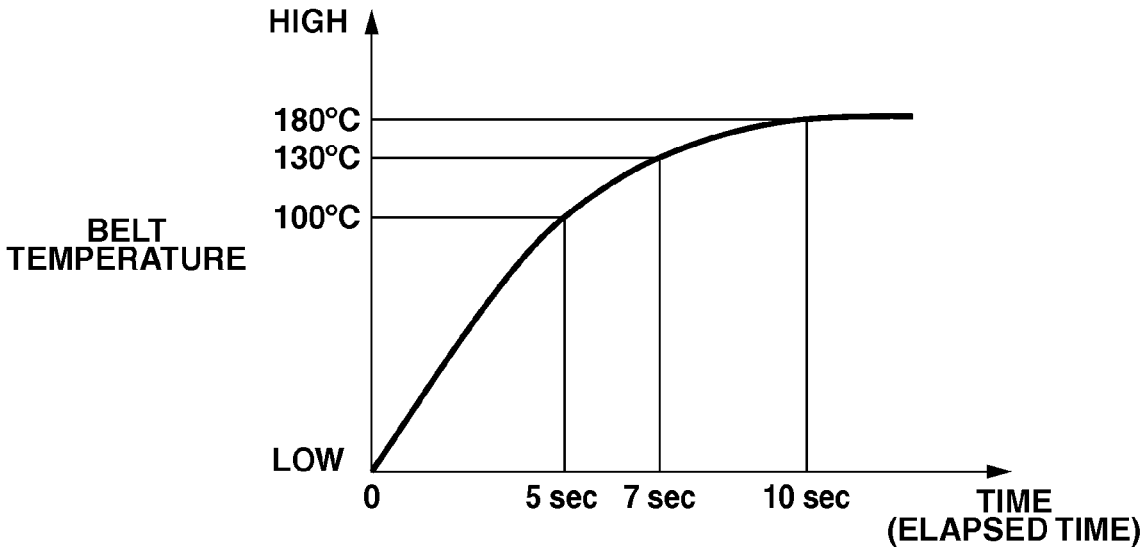
FIG. 6 is a graph illustrating a relationship between a heating time and a belt temperature.

FIG. 6 indicates the relationship between an elapsed time from a start of power input and a belt temperature according to the present experiments. As shown in FIG. 6, it is confirmed that when the belt temperature was 100° C., it takes five seconds to reach the target temperature (180° C.), and when the belt temperature was 130° C., it takes three seconds.

(5) Relationship Between Auxiliary Heating State at End Portion and Image Gloss after Fixing Next, experiments were conducted with respect to a relationship between an auxiliary heating state at an end portion and image gloss after fixing. In this description, the end portion is a heater portion or a belt portion corresponding to a non passing portion when a recording material (a small size recording material) which is smaller in width than a recording material having the maximum passing width B (a maximum size recording material) passes through the maximum heating area width A of the heater 44. When a recording material is conveyed in the central reference conveyance, a non passing portion with a width of (the maximum passing width B−a passing width of the small size recording material)/2 is generated each on both end sides of the passing portion of the small size recording material. When a recording material is the maximum size recording material, the non passing portion is not generated in the heater 44.

The auxiliary heating of the end portion is described below. Specifically, when the small size recording material passes through the fixing apparatus, the power is supplied to the individual heat generating member corresponding to the passing portion so as to heat the heater portion (the belt portion) corresponding to the passing portion up to the predetermined target temperature. In addition, the individual heat generating member corresponding to the non passing portion is also controlled to be input predetermined power so as to heat the heater portion (the belt portion) corresponding to the non passing portion up to a predetermined temperature (a predetermined second temperature lower than the first temperature).

The image gloss after fixing is a state of image gloss of a fixed image portion corresponding to the passing portion of a small size recording material and a fixed image portion corresponding to the non passing portion thereof, when a large size recording material larger in width than the small size recording material passes through the heater after the small size recording material passed therethrough.

In the present experiments, the fixing apparatus 40 as illustrated in FIGS. 1, 2A, 2B, 4A, and 4B was used. As for operation conditions, a belt rotation speed was 248 mm/s, a total pressing force was 314 N (32 kgf), and the target temperature of the belt 43 was 180° C.

Next, an energization state of the heater 44 is described. In the present experiments, first, a total of 800 W of power was applied to all of the first to fifth individual heat generating members 44b-1 to 44b-5 to heat the belt 43 up to the target temperature of 180° C. In other words, the entire length area of the maximum heating area width A of the heater 44 (an area corresponding to the maximum passing width of the belt 43) was heated to 180° C.

Then, when a print operation was performed using a recording material with a width of 148 mm (the A5 vertical size), namely the small size recording material, 400 W of power was applied to the third heat generating member 44b-3 positioned on the passing portion of the recording material. Further, a temperature of the heater portion (the belt portion) corresponding to the heat generation width of the third heat generating member 44b-3 was controlled to be 180° C.

On the other hand, the power input to the first, second, fourth, and fifth heat generating members 44b-1, 44b-2, 44b-4, and 44b-5 corresponding to the non passing portion of the recording material were set to three cases as described below, and the image gloss after fixing was examined for each of the three cases.

Case 1: The power input to the individual heat generating members 44b-1, 44b-2, 44b-4, and 44b-5 corresponding to the non passing portion was 0 W (the case that the power is not input).

Case 2: The power input to the individual heat generating members 44b-1, 44b-2, 44b-4, and 44b-5 corresponding to the non passing portion was 25 w.

Case 3: The power input to the individual heat generating members 44b-1, 44b-2, 44b-4, and 44b-5 corresponding to the non passing portion was 50 w.

The evaluation method is described below. First, 50 sheets of A5 size recording materials of CS-680 (manufactured by Nippon Paper Industries Co., Ltd., 148 mm *210 mm) as the small size recording material were continuously passed through the fixing apparatus 40 in a direction that its longitudinal direction was 148 mm (the A5 vertical size). Then, as the large size recording material, an A4 size recording material of CS-680 (manufactured by Nippon Paper Industries Co., Ltd., 210 mm *297 mm) on which an unfixed toner was applied with an amount of 1.2 mg/cm$^2$ was passed through the fixing apparatus 40 in a direction that its longitudinal direction was 297 mm (the A4 horizontal size).

Then, 60° degree gloss of an image obtained after fixing processing was measured using a handy type gloss meter (manufactured by Nippon Denshoku Industries Co., Ltd), and a heating time of the end portion which was required to make a gloss value at the end portion the same level as a gloss value at the center portion in the recording material width direction was compared with each other cases. The results are indicated in Table 2. The center portion and the end portion in the recording material width direction in the large size recording material are portions corresponding to the passing portion and the non passing portion of the previous small size recording material.

TABLE 2

| Input power to the individual heat generating members in the non sheet passing portion | Belt temperature of the non sheet passing portion | Required time amount |
|---|---|---|
| 0 W (No power applied) | 25° C. | 10 sec |
| 25 W | 100° C. | 5 sec |
| 50 W | 130° C. | 3 sec |

Figure 7:
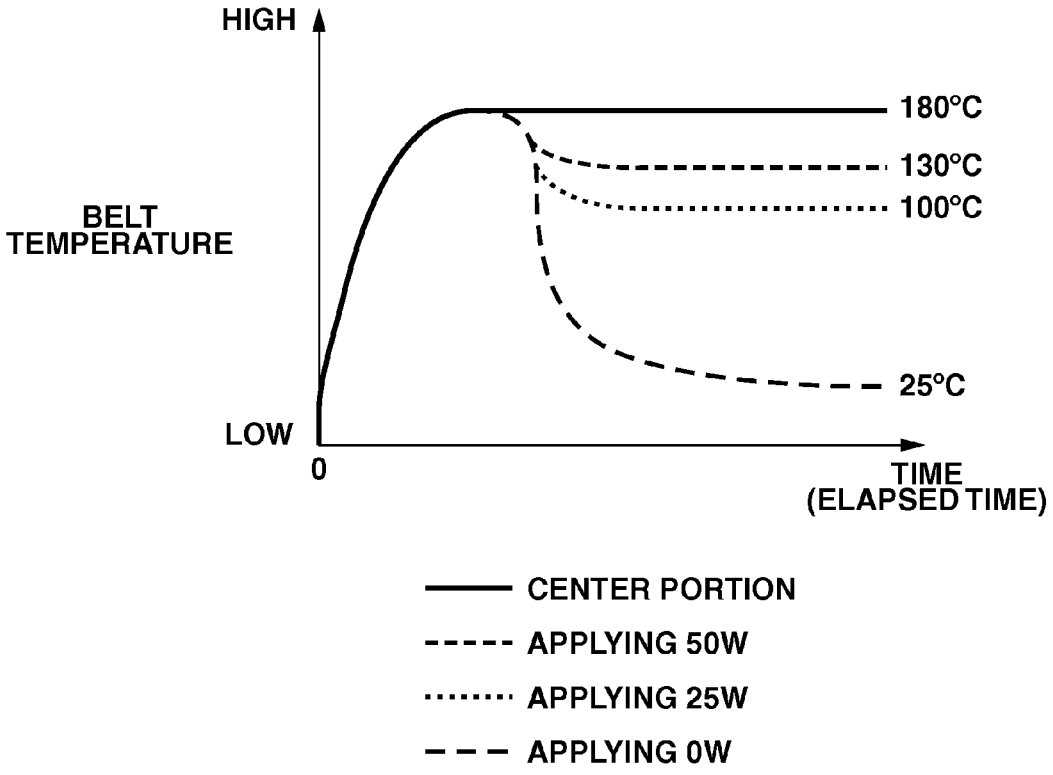
FIG. 7 is a graph illustrating a relationship between an elapsed time and a belt temperature under control according to the first exemplary embodiment.

FIG. 7 is a graph illustrating heating conditions of the end portion (the non passing portion) and temperature transition of the belt 43 after reaching the target temperature. A temperature at the center portion (the belt portion corresponding to the passing portion of the previous small size recording material) is constant at 180° C., and a temperature of the non passing portion to be constant is different according to the power applied to the individual heat generating member corresponding to the non passing portion.

When the power is not applied to the individual heat generating member of the non passing portion, a temperature of the belt end portion falls to 25° C., which is a room temperature. When 25 W of power is applied, a temperature becomes constant at 100° C. When 50 W of power is applied, a temperature becomes constant at 130° C. Since the temperatures to be constant are different, the time amount required to heat the non passing portion up to the target temperature 180° C. next time is ten seconds in the case that no power is applied. In the cases of the auxiliary heating by applying 25 W and 50 W of power, the required time amounts are five seconds and three seconds, respectively. In other words, it can be confirmed that if the auxiliary heating is performed on the non passing portion, the time amount required to heat the non passing portion up to the target temperature next time can be shortened.

From a standpoint of the productivity at the time of switching a size of a recording material, a desirable required time amount is about three seconds. Therefore, it can be confirmed that a target required time amount at the time of switching the size can be satisfied by applying 50 W of power to the individual heat generating member at the non passing portion.

(6) Switching Size of Recording Material and Auxiliary Heating Control

Figure 8A:
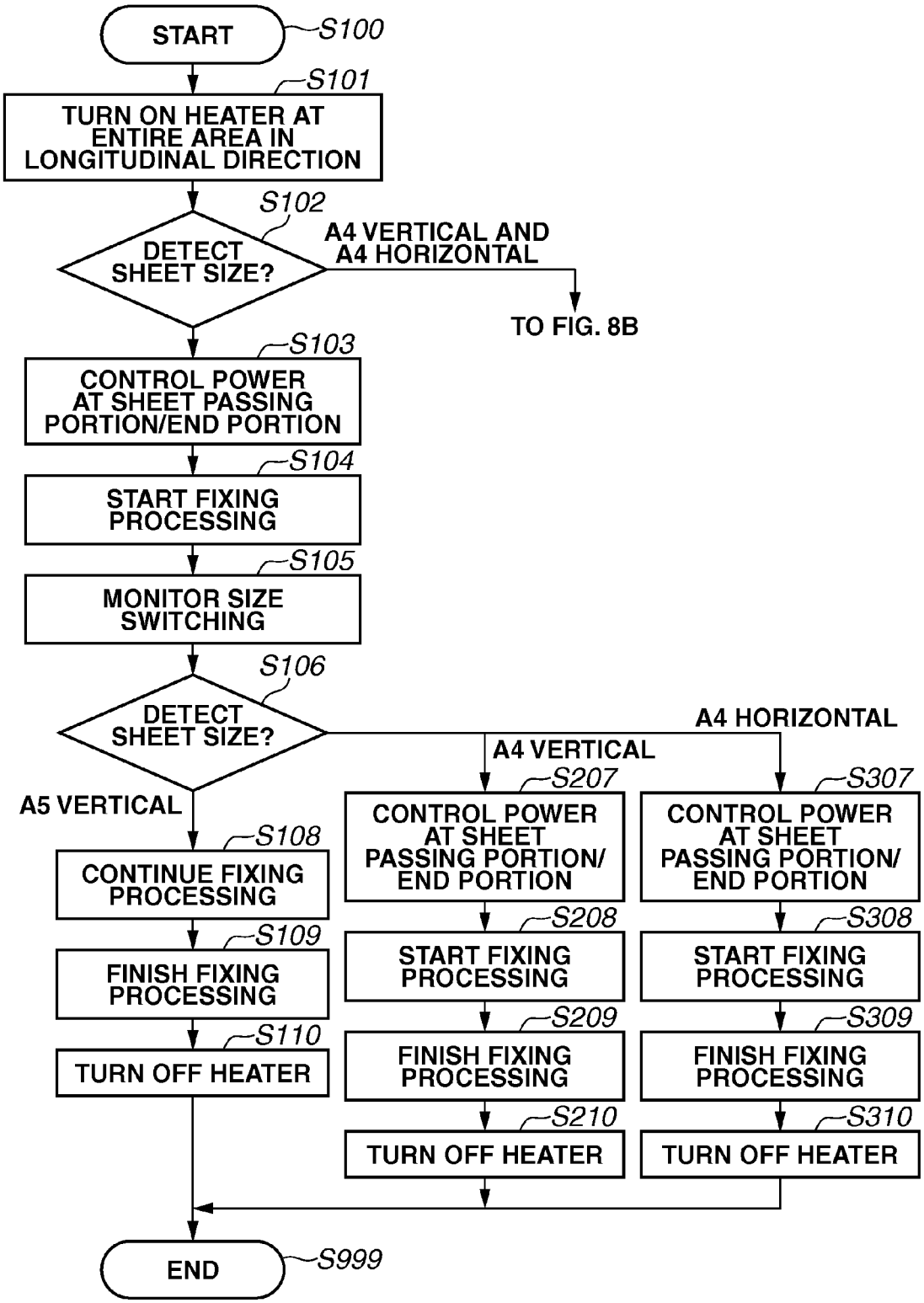
FIG. 8A is a control flowchart (No. 1) of the fixing apparatus according to the first exemplary embodiment.
Figure 8B:
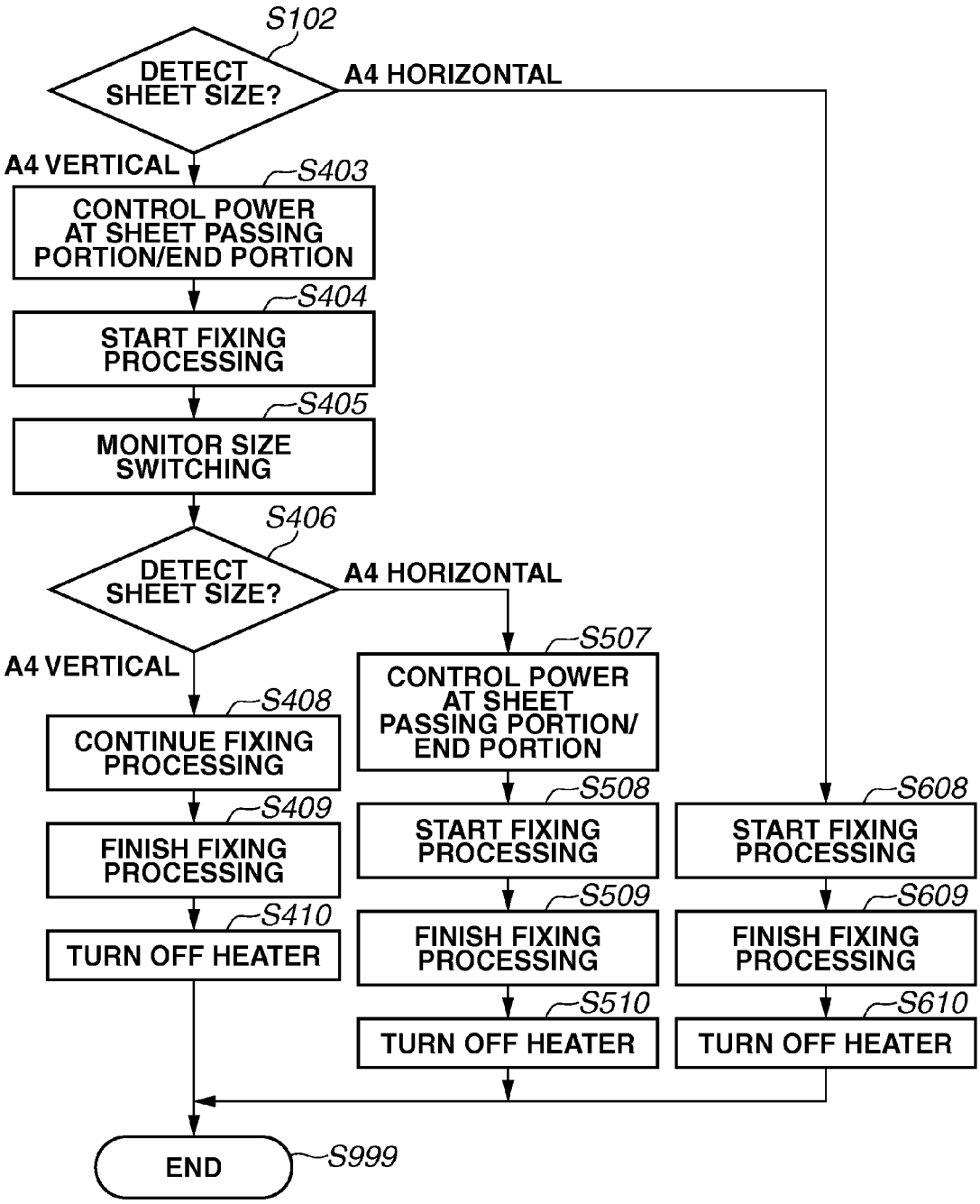
FIG. 8B is a control flowchart (No. 2) of the fixing apparatus according to the first exemplary embodiment.

FIG. 8A and FIG. 8B are flowcharts illustrating the operation control of the fixing apparatus including switching of a size of a recording material and the auxiliary heating control according to the first exemplary embodiment. Each step in the flowchart is described below. The operation control of the fixing apparatus is executed by the control unit 24.

In step S100: An image formation operation of the image forming unit 2 is started based on an image formation start signal.

In step S101: With respect to the fixing apparatus 40, rotational driving of the pressure roller 42 is started at a predetermined control timing. In addition, energization to all of the first to fifth individual heat generating members 44*b*-1 to 44*b*-5 is started (turn ON the heater at an entire area in the longitudinal direction) to raise a temperature of the entire length area of the maximum heating area width A of the heater 44 up to 180° C. (the first temperature).

According to the first exemplary embodiment, 400 W of power is applied to the third individual heat generating member 44*b*-3 in the center portion in the longitudinal direction. To the other first, second, fourth, and fifth individual heat generating members 44*b*-1, 44*b*-2, 44*b*-4, and 44*b*-5, 100 W of power is applied individually. In addition, the power supply to each of the individual heat generating members is separately controlled by a temperature control system including the first to fifth thermistors TH1 to TH5 so that a temperature of the heater portion (the belt portion) corresponding to each of the individual heat generating members is raised to and maintained of 180° C.

In step S102: A size of a recording material to be used is detected. The size detection of a recording material is performed in the way that, for example, the host apparatus 23 inputs information of the recording material to be used to the control unit 24. Alternatively, the size detection may be performed in the way that a user inputs the recording material information that the user selects and specifies from an operation unit 27 of the image forming apparatus 1 to the control unit 24. Further alternatively, the size detection may be performed in the way that a unit (not illustrated) for automatically detecting a size of a recording material fed from a sheet feeding unit inputs detected size information to the control unit 24.

According to the first exemplary embodiment, widths of recording materials which can be used in the fixing apparatus by switching sizes are three types, namely the A5 vertical size (148 mm wide), the A4 vertical size (210 mm wide), and the A4 horizontal size (297 mm wide), for convenience sake. The A4 horizontal size is regarded as the large size recording material width, and either of the A5 vertical size and the A4 vertical size is regarded as the small size recording material width with respect to the large size recording material width of the A4 horizontal size.

In step S102, when the detected size of the recording material to be used is the A5 vertical size, the processing proceeds to step S103. When the detected size of the recording material is a width size other than that, the processing proceeds to the flowchart in FIG. 8B.

In step S103: When the recording material size is the A5 vertical size, 400 W of power is applied to the layer of the third individual heat generating member 44*b*-3 corresponding to the passing portion of the recording material so that temperature control is performed to maintain the belt temperature of the passing portion of the target temperature 180° C.

Power control is performed to apply 50 W of power to each layer of the first, second, fourth, and fifth individual heat generating members 44*b*-1, 44*b*-2, 44*b*-4, and 44*b*-5 corresponding to the non passing portion so that the belt portion corresponding to the non passing portion is subjected to the auxiliary heating.

In step S104: Passing and fixing processing of the recording material having the A5 vertical size are started in the control state of the fixing apparatus 40.

In step S105: Switching of the size of the recording material during the operation of the image forming apparatus is monitored.

In step S106: When the recording material size continues to be the A5 vertical size, the processing proceeds to step S108. When the recording material size is switched to the A4 vertical size, the processing proceeds to step S207. When the recording material size is switched to the A4 horizontal size, the processing proceeds to step S307.

In step S108: When the recording material size continues to be the A5 vertical size, the passing and the fixing processing of the recording material are continued.

In step S109: The passing and the fixing processing for a predetermined set number of sheets are finished.

In step S110: The energization to all layers of the first to fifth individual heat generating members 44*b*-1 to 44*b*-5 is stopped (turn OFF the heater) at a predetermined control timing, and driving of the pressure roller 42 is also stopped.

In step S999: The image forming apparatus 1 is maintained in a standby state until a start signal of a next image formation job is input.

In step S207: When the size is switched to the A4 vertical size in step S106, a predetermined power is applied to the layers of the second, third, and fourth individual heat generating members 44*b*-2, 44*b*-3, and 44*b*-4 corresponding to the passing portion of the recording material. Then, the temperature control is performed to maintain the belt temperature of the passing portion of the target temperature 180° C. According to the first exemplary embodiment, 400 W of power is applied to the layer of the third individual heat generating member 44*b*-3, and 100 W of power is applied to each layer of the second and fourth individual heat generating members 44*b*-2 and 44*b*-4.

The power control is performed to apply 50 W of power to each layer of the first and fifth individual heat generating members 44*b*-1 and 44*b*-5 corresponding to the non passing portion so that the belt portion corresponding to the non passing portion is subjected to the auxiliary heating.

In step S208: The passing and the fixing processing of the recording material are started in the control state of the fixing apparatus 40.

In step S209: The passing and the fixing processing for a predetermined set number of sheets are finished.

In step S210: The energization to all layers of the first to fifth individual heat generating members 44*b*-1 to 44*b*-5 is stopped (turn OFF the heater) at a predetermined control timing, and the driving of the pressure roller 42 is also stopped.

In step S999: The image forming apparatus 1 is maintained in the standby state until a start signal of a next image formation job is input.

In step S307: When the size is switched to the A4 horizontal size in step S106, the recording material is a recording material having the maximum passing width B, so that the entire length area of the maximum heating area width A of the heater 44 is heated to and maintained of 180° C. According to the first exemplary embodiment, 400 W of power is applied to the third individual heat generating member 44*b*-3 in the center portion in the longitudinal direction. To the other first, second, fourth, and fifth individual heat generating members 44*b*-1, 44*b*-2, 44*b*-4, and 44*b*-5, 100 W of power is applied individually.

In addition, the power supply to each of the individual heat generating members is separately controlled by the temperature control system including the first to fifth thermistors TH1 to TH5 so that the temperature of the heater portion (the belt portion) corresponding to each of the individual heat generating members is raised to and maintained of 180° C.

In step S308: The passing and the fixing processing of the recording material are started in the control state of the fixing apparatus 40.

In step S309: The passing and the fixing processing for a predetermined set number of sheets are finished.

In step S310: The energization to all layers of the first to fifth individual heat generating members 44*b*-1 to 44*b*-5 is stopped (turn OFF the heater) at a predetermined control timing, and the driving of the pressure roller 42 is also stopped.

In step S999: The image forming apparatus 1 is maintained in the standby state until a start signal of a next image formation job is input.

In step S102: Referring to FIG. 8B, when the detected size of the recording material is the A4 vertical size in step S102 in FIG. 8A, the processing proceeds to step S403. Whereas, when the detected size of the recording material is the A4 horizontal size, the processing proceeds to step S608.

In step S403: In the case of the A4 vertical size, a predetermined power is applied to the layers of the second, third, and fourth individual heat generating members 44*b*-2, 44*b*-3, and 44*b*-4 corresponding to the passing portion of the recording material so that the temperature control is performed to maintain the belt temperature of the passing portion of the target temperature 180° C. According to the first exemplary embodiment, 400 W of power is applied to the layer of the third individual heat generating member 44*b*-3, and 100 W of power is applied to each layer of the second and fourth individual heat generating members 44*b*-2 and 44*b*-4.

The power control is performed to apply 50 W of power to each layer of the first and fifth individual heat generating members 44*b*-1 and 44*b*-5 corresponding to the non passing portion so that the belt portion corresponding to the non passing portion is subjected to the auxiliary heating.

In step S404: The passing and the fixing processing of the recording material having the A4 vertical size are started in the control state of the fixing apparatus 40.

In step S405: Switching of the size of the recording material during the operation of the image forming apparatus is monitored.

In step S406: When the recording material size continues to be the A4 vertical size, the processing proceeds to step S408. When the recording material size is switched to the A4 horizontal size, the processing proceeds to step S507.

In step S408: When the recording material size continues to be the A4 vertical size, the passing and the fixing processing of the recording material are continued.

In step S409: The passing and the fixing processing for a predetermined set number of sheets are finished.

In step S410: The energization to all layers of the first to fifth individual heat generating members 44*b*-1 to 44*b*-5 is stopped (turn OFF the heater) at a predetermined control timing, and the driving of the pressure roller 42 is also stopped.

In step S999: The image forming apparatus 1 is maintained in the standby state until a start signal of a next image formation job is input.

In step S507: When the size is switched to the A4 horizontal size in step S406, the recording material is a recording material having the maximum passing width B, so that the entire length area of the maximum heating area width A of the heater 44 is heated to and maintained of 180° C. According to the first exemplary embodiment, 400 W of power is applied to the third individual heat generating member 44*b*-3 in the center portion in the longitudinal direction. To the other first, second, fourth, and fifth individual heat generating members 44*b*-1, 44*b*-2, 44*b*-4, and 44*b*-5, 100 W of power is applied individually.

In addition, the power supply to each of the individual heat generating members is separately controlled by the temperature control system including the first to fifth thermistors TH1 to TH5 so that the temperature of the heater portion (the belt portion) corresponding to each of the individual heat generating members is raised to and maintained of 180° C.

In step S508: The passing and the fixing processing of the recording material are started in the control state of the fixing apparatus 40.

In step S509: The passing and the fixing processing for a predetermined set number of sheets are finished.

In step S510: The energization to all layers of the first to fifth individual heat generating members 44*b*-1 to 44*b*-5 is stopped (turn OFF the heater) at a predetermined control timing, and the driving of the pressure roller 42 is also stopped.

In step S999: The image forming apparatus 1 is maintained in the standby state until a start signal of a next image formation job is input.

In step S608: When the detected size of the recording material is the A4 horizontal size in step S102 in FIG. 8A, the passing and the fixing processing of the recording material having the A4 horizontal size are started in the control state of the fixing apparatus 40 in step S101.

In step S609: The passing and the fixing processing for a predetermined set number of sheets are finished.

In step S610: The energization to all layers of the first to fifth individual heat generating members 44*b*-1 to 44*b*-5 is stopped (turn OFF the heater) at a predetermined control timing, and the driving of the pressure roller 42 is also stopped.

In step S999: The image forming apparatus 1 is maintained in the standby state until a start signal of a next image formation job is input.

Table 3 indicates required time amounts when a size of a recording material is switched in a case where the fixing apparatus 40 is controlled as illustrated in FIG. 8A and FIG. 8B.

TABLE 3

| Sheet size switching | Width size to be changed | Required time amount |
|---|---|---|
| A5R to A4R | 148 mm to 210 mm | 3 sec |
| A4R to A4 | 210 mm to 297 mm | 3 sec |
| A5R to A4 | 148 mm to 297 mm | 3 sec |

As described above, it can be confirmed that the control according to the first exemplary embodiment can make a required time amount for switching a size of a recording material three seconds (7) Comparison with Comparative Examples Next, the first exemplary embodiment was compared with comparative examples. As for the operation conditions, a belt rotation speed was 248 mm/s, a total pressing force was 314 N (32 kgf), and the target temperature of the belt was 180° C.

The evaluation method is as follows. 50 sheets of A5 size recording materials of CS-680 (manufactured by Nippon Paper Industries Co., Ltd., 148 mm*210 mm) as the small size recording material were passed through the fixing apparatus in the direction that its longitudinal direction was 148 mm (the A5 vertical size). Then, as the large size recording material, an A4 size recording material of CS-680 (manufactured by Nippon Paper Industries Co., Ltd., 210 mm*297 mm) on which an unfixed toner was applied with an amount of 1.2 $mg/cm^2$ was passed through the fixing apparatus in a direction that its longitudinal direction was 297 mm (the A4 horizontal size).

As for the evaluation, 60° degree gloss of an image was measured using a handy type gloss meter (manufactured by Nippon Denshoku Industries Co., Ltd), and a heating time of the end portion which was required to making a gloss value at the end portion the same level as a gloss value at the center portion in the recording material width direction was compared with each other cases.

The center portion and the end portion in the recording material width direction in the large size recording material are portions corresponding to the passing portion and the non passing portion of the previous small size recording material.

As for a fixing apparatus according to a first comparative example, the fixing apparatus 40 according to the first exemplary embodiment is used, but the fixing apparatus includes a heater, as the heater 44, of which entire length area of the maximum heating area width A is composed of a single heat generating member and a cooling fan (a non passing portion cooling fan) which is disposed on the end portion. Further, the fixing apparatus is configured to cool down the belt to a predetermined temperature by the cooling fan when a temperature of the non passing portion rises due to continuous printing of the small size recording materials.

As for a fixing apparatus of a second comparative example, the fixing apparatus 40 according to the first exemplary embodiment is used, and the fixing apparatus is configured to perform control not to input power to the individual heat generating member corresponding to the non passing portion in the case of passing of the small size recording material. More specifically, the second comparative example is a case in which the auxiliary heating is not performed on the end portion (the non passing portion) in the fixing apparatus 40 according to the first exemplary embodiment.

Required time amounts for changing a size of a recording material (a time amount required for heating the non passing portion up to the target temperature) according to the above described first exemplary embodiment, first comparative example, and second comparative example are indicated in Table 4. A center portion temperature is a temperature of the belt portion corresponding to the passing portion when the small size recording material passes through, and an end portion temperature is a temperature of the belt portion corresponding to the non passing portion.

TABLE 4

| | Center portion temperature | End portion temperature | Required time amount |
|---|---|---|---|
| First exemplary embodiment | 180° C. | 130° C. | 3 sec |
| First comparative example | 180° C. | 220° C. | 30 sec |
| Second comparative example | 180° C. | 25° C. | 10 sec |

In the case of the first comparative example, a long cooling period is required when a temperature of the non passing portion becomes high, so that the required time amount for changing a size of a recording material is considerably lengthened.

In the case of the second comparative example, a temperature of the non passing portion is maintained of 25° C., however, it takes ten seconds to raise the temperature from 25° C. to the target temperature 180° C. next time, which is the same level with an initial rise time, and the required time amount is lengthened.

On the contrary, according to the first exemplary embodiment, a temperature of the belt is maintained of a constant temperature (the second temperature) which is higher than the second comparative example and lower than the target temperature (the first temperature) by the individual heat generating member corresponding to the non passing portion. Therefore, it can be confirmed that the required time amount to raise the temperature (the second temperature) up to the target temperature (the first temperature) 180° C. next time is shortened.

As described above, according to the first exemplary embodiment, even when a sheet width is changed from the small size recording material to the large size recording material, the fixing apparatus can continue the fixing processing which does not cause an image defect and failure in conveyance of the recording material without causing reduction in the productivity due to the down-time or the like.

[Second Exemplary Embodiment]

A second exemplary embodiment is directed to an issue caused by thermal expansion of the pressure roller 42. More specifically, when the small size recording material passes through the fixing apparatus, heat is transferred to a portion corresponding to the passing portion of the pressure roller via the recording material, and the temperature thereof rises. On the other hand, in an apparatus configuration which does not generate heat at the heater portion corresponding to the non passing portion, a portion corresponding to the non passing portion of the pressure roller is not heated, so that the temperature thereof hardly rises.

The elastic member layer 42*b* of the pressure roller 42 expands with heating, so that only roller portion corresponding to the passing portion expands and a roller portion corresponding to the non passing portion hardly expands. In the fixing apparatus which passes through a recording material by the central reference conveyance, only the center portion in the passing portion of the pressure roller 42 is heated and expands, and the both end portions of the non passing portion does not cause expansion. Therefore, a shape of the pressure roller 42 becomes a nearly crown shape in which the center portion is thicker than the both end portions.

Generally, a thickness of the elastic member layer 42*b* is set large so as to secure an enough nip area in the pressure roller 42. If the elastic member layer 42*b* becomes thicker, the elastic member layer 42*b* expands longer, so that the crown shape thereof becomes more noticeable. If a large size recording material passes through the roller in this state, a conveyance speed of the recording material will be higher at a center area than the both end portion areas. Especially, in a case where a thin large size recording material passes through the roller immediately after a large number of small size recording materials passed therethrough, paper creases may be sometimes generated on the recording material since the thin large size recording material has small paper rigidity and the conveyance speed is different at the center portion and the both end portions.

Regarding this issue, it can be solved by refraining from receiving a next job until a temperature difference in the pressure roller 42 becomes small and the crown shape caused by the expansion subsides after the small size recording material passed through the roller. However, the elastic member layer 42*b* of the pressure roller 42 is large in thickness, large in volume, and large in thermal capacity, thus it takes long time to cool down. Generation of a long waiting time may cause a problem that the productivity of the fixing apparatus is enormously reduced.

The second exemplary embodiment and third and fourth exemplary embodiments, which are described below, are directed to the above-described issue caused by the thermal expansion of the pressure roller 42. The configuration of the image forming apparatus 1 and the configuration of the fixing apparatus 40 according to the second exemplary embodiment are the same as those according to the first exemplary embodiment, so that the descriptions thereof are not repeated.

(1) Relationship of Pressure Roller Temperature Between Passing Portion and Non Passing Portion Experiments were conducted with respect to temperature transition in the pressure roller 42 when a size of a recording material to pass through was changed and a relationship of temperature between the center portion (the passing portion) and the end portion (the non passing portion) in the longitudinal direction of the pressure roller 42 when the small size recording material passed through. In the present experiments, the fixing apparatus 40 according to the first exemplary embodiment was used. As for operation conditions, a belt rotation speed was 248 mm/s, a total pressing force was 314 N (32 kgf), and the input power to the heater 44 was 800 W which was a total of the input power to the five individual heat generating members 44*b*-1 to 44*b*-5. Further, the target temperature to be reached was 180° C. which is a fixing belt back surface temperature (hereinbelow, referred to as the belt temperature) detected by the thermistors TH1 to TH5

Figure 9A:
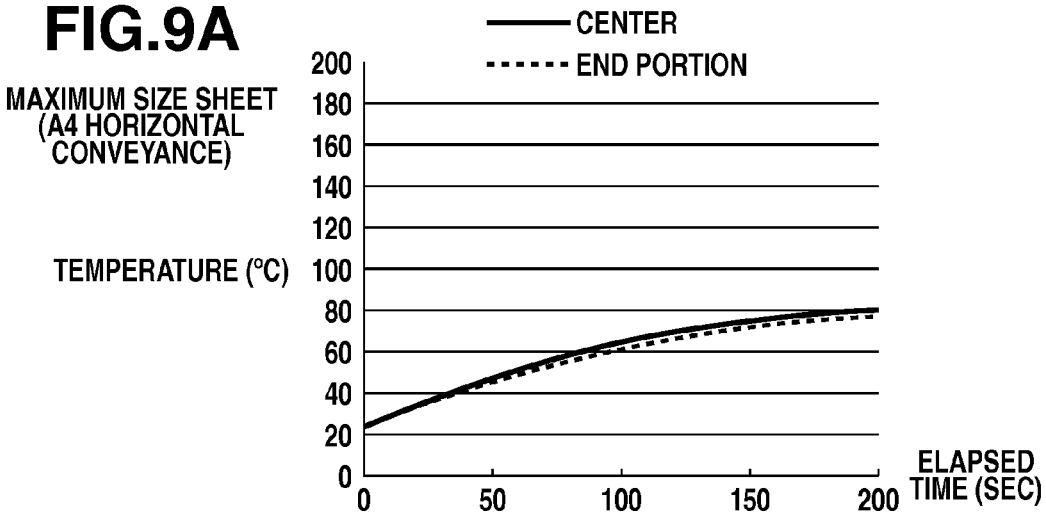
FIGS. 9A to 9C are graphs illustrating relationships between an elapsed time from a start of power input to a heater of a fixing apparatus and a temperature of a pressure roller in experiments according to a second exemplary embodiment.
Figure 9B:
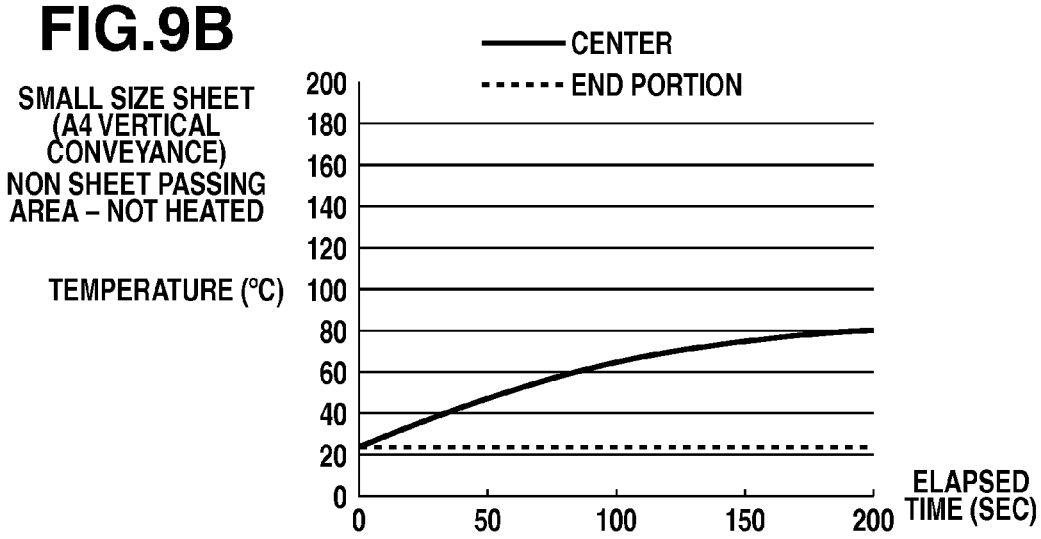
Figure 9C:
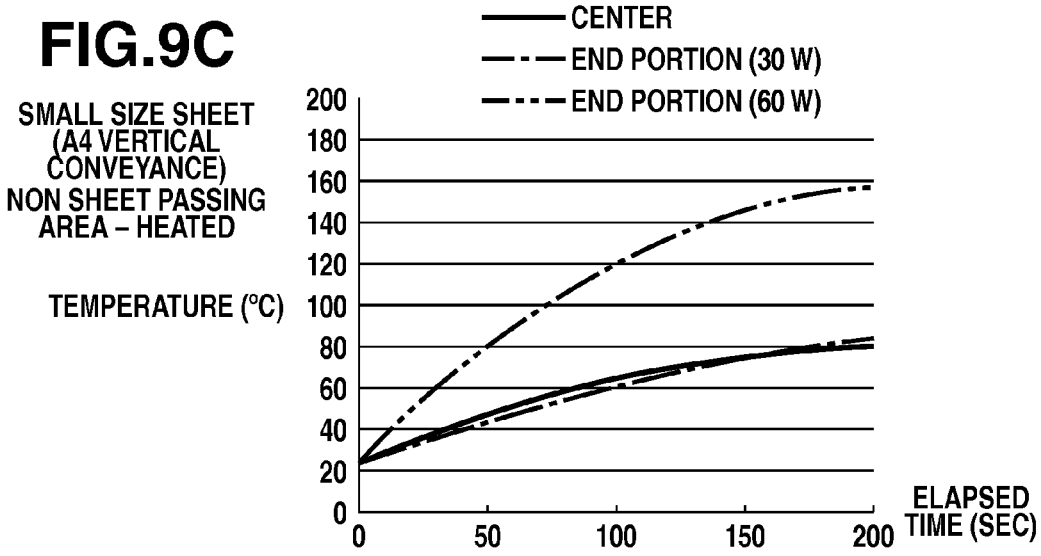

FIGS. 9A to 9C illustrate relationships between an elapsed time from a start of power input to the heater 44 of the fixing apparatus 40 and a temperature of the pressure roller 42 in the present experiments. FIG. 9A shows the temperature transition when a recording material having the A4 horizontal size (297 mm wide), which is the maximum size recording material, passes through the fixing apparatus. All layers of the first to fifth individual heat generating members 44*b*-1 to 44*b*-5 are energized. 120 W of power is applied to each of the layers of the first and fifth individual heat generating members 44*b*-1 and 44*b*-5, 80 W of power is applied to each of the layers of the second and fourth individual heat generating members 44*b*-2 and 44*b*-4, and 400 W of power is applied to the layer of the third individual heat generating member 44*b*-3.

When the maximum size recording material passes through the fixing apparatus, the entire length area of the maximum heating area width A of the heater 44 is the passing portion, and there is no non passing portion. In the passing area of the maximum size recording material, a temperature of the pressure roller rises by being heated by the heater 44 via the recording material P and the belt 43. The temperature reaches about 80° C. in approximately 200 seconds. In this case, temperatures at the center portion and the end portion of the pressure roller 42 in the longitudinal direction are almost the same, expansion amounts of the pressure roller 42 are also the same at the center portion and the end portion.

Figure 10A:
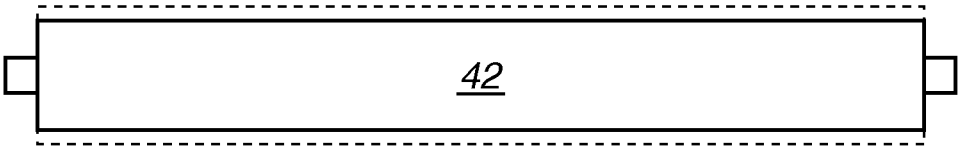
FIGS. 10A to 10C are schematic drawings illustrating forms of thermal expansion of a passing portion and a non passing portion of the pressure roller.

As schematically illustrated in FIG. 10A, the shape of the pressure roller before the passage of the recording material shown by a solid line changes to the shape shown by a broken line after the passage. A diameter of the pressure roller becomes large by the thermal expansion, but an external shape is not changed since there is no temperature difference between the center portion and the end portion.

FIG. 9B shows the temperature transition of the center portion and the end portion of the pressure roller in the longitudinal direction in a case where power is applied to only the individual heat generating member corresponding to the passing portion of the recording material and no power is applied to the individual heat generating member corresponding to the non passing portion when a small size recording material passes through the fixing apparatus. More specifically, it is a case when a recording material having the A4 vertical size (210 mm wide) passes through the fixing apparatus. In other words, three of the second, third, and fourth individual heat generating members 44*b*-2, 44*b*-3, and 44*b*-4 corresponding to the passing portion of the recording material are only energized, and the first and fifth individual heat generating members 44*b*-1 and 44*b*-5 corresponding to the non passing portion thereof are not energized.

400 W of power is applied to the third individual heat generating member 44*b*-3, 80 W of power is applied to each of the second and fourth individual heat generating members 44*b*-2 and 44*b*-4, and 0 W of power is applied each of the first and fifth individual heat generating members 44*b*-1 and 44*b*-5.

At the center portion corresponding to the passing portion of the pressure roller 42, a temperature of the pressure roller rises by being heated by the heater 44 via the recording material P and the belt 43. The temperature reaches about 80° C. in approximately 200 seconds. A temperature of the end portion corresponding to the non passing portion of the pressure roller 42 does not rise since it is not heated by the heater 44. In this case, the temperature of the pressure roller 42 is greatly different at the center portion and the end portion, therefore the thermal expansion amount of the pressure roller 42 is also different at the center portion and the end portion.

Figure 10B:
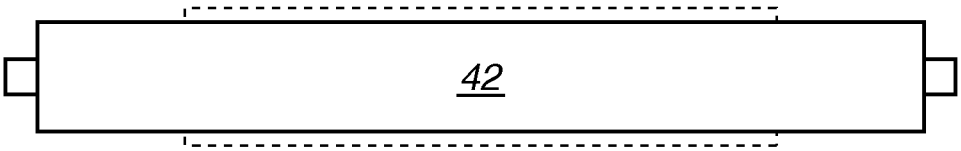

As schematically illustrated in FIG. 10B, the shape of the pressure roller before the passage of the recording material shown by a solid line changes to the shape shown by a broken line after the passage. A coefficient of cubic expansion is $1.05*10^{-3}$° $C.^{-1}$, the temperature difference is 65° C., and an outer diameter difference is approximately 0.5 mm when a thickness of the elastic member layer 42*b* is 5 mm. A radius at the center portion of the pressure roller 42 is approximately 0.5 mm larger than that of the end portion.

According to this difference, in the width direction of the nip portion N, a conveyance speed of a recording material at the center portion is faster than that of the end portion. Therefore, if a thin large size recording material passes through the pressure roller 42 in this state, paper creases may be generated on the recording material since the thin large size recording material has small paper rigidity and the conveyance speed is different at the center portion and the both end portions.

In addition, the belt 43 includes the elastic layer 43*b*, so that the belt 43 also expands by the temperature rise. However, a thickness of the elastic layer 43*b* of the belt 43 is 300 μm, and the thickness of the elastic member layer 42*b* of the pressure roller 42 is 5 mm. Thus, an expansion amount of the belt is about one-tenth of the pressure roller and no paper crease is generated. In other words, the expansion amount at the time of heating is larger in the pressure roller 42 than in the belt 43.

FIG. 9C shows the temperature transition of the center portion and the end portion of the pressure roller in the longitudinal direction in a case where the individual heat generating member corresponding to the non passing portion is also energized when a small size recording material passes through the fixing apparatus. More specifically, it is a case when a recording material having the A4 vertical size passes through the fixing apparatus similar to the case shown in FIG. 9B. In this case, not only three of the second, third, and fourth individual heat generating members 44*b*-2, 44*b*-3, and 44*b*-4 corresponding to the passing portion of the recording material but also the first and fifth individual heat generating members 44*b*-1 and 44*b*-5 corresponding to the non passing portion thereof are energized.

At the center portion, namely the passing portion of the pressure roller 42, a temperature of the pressure roller rises by being heated by the heater 44 via the recording material P and the belt 43. The temperature reaches about 80° C. in approximately 200 seconds. A temperature of the end portion corresponding to the non passing portion rises by being heated by the first and fifth individual heat generating members 44*b*-1 and 44*b*-5 corresponding to the non passing portion via the belt 43. The passing portion area of the pressure roller 42 is heated by the heat generating member via the recording material P and the belt 43, whereas the non passing portion area is heated by the heat generating member via only the belt 43, thus the temperature of the non passing portion area can be raised by a smaller power.

In FIG. 9C, a solid line indicates the temperature transition at the center portion of the pressure roller in the longitudinal direction. An alternate long and short dash line indicates the temperature transition at the end portion of the pressure roller 42 when 30 W of power is applied to each of the first and fifth individual heat generating members 44*b*-1 and 44*b*-5 corresponding to the non passing portion. An alternate long and two short dashes line indicates the temperature transition at the end portion of the pressure roller 42 when 60 W of power is applied to each of the first and fifth individual heat generating members 44*b*-1 and 44*b*-5 corresponding to the non passing portion.

Figure 10C:
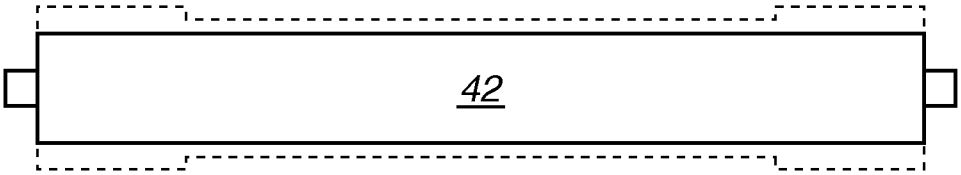

When 60 W of power is applied to the first and fifth individual heat generating members 44*b*-1 and 44*b*-5, the temperature of the end portion rises more than the temperature rise at the center portion. Therefore, the end portion expands by the heat more than the center portion, and as schematically illustrated in FIG. 10C, the shape of the pressure roller before the passage of the recording material shown by a solid line changes to the shape shown by a broken line after the passage. A coefficient of cubic expansion is $1.05*10^{-3}$° C.$^{-1}$, the temperature difference is 80° C., and an outer diameter difference is approximately 0.6 mm when a thickness of the elastic member layer 42*b* is 5 mm. According to this difference, in the width direction of the nip portion, a conveyance speed of a recording material at the center portion is slower than that of the end portion.

Therefore, if a thin large size recording material passes through the pressure roller 42 in this state, behavior of a rear end of the sheet may be unstable since the thin large size recording material has small paper rigidity and the conveyance speed is different at the center portion and the both end portions in the width direction of the nip portion. Further, there is a possibility that the recording material abuts on the belt 43 before entering into the nip portion and cause an image defect.

When 30 W of power is applied to the first and fifth individual heat generating members 44*b*-1 and 44*b*-5, a temperature of the end portion rises similarly to that of the center portion in the longitudinal direction of the pressure roller. In this case, the temperature of the center portion (a temperature of a portion corresponding to the passing portion) and the temperature of the end portion (a temperature of a portion corresponding to the non passing portion) in the longitudinal direction of the pressure roller are almost the same, so that the thermal expansion amount of the pressure roller is not different in the center portion and the end portion.

As schematically illustrated in FIG. 10A, the shape of the pressure roller before the passage of the recording material shown by a solid line changes to the shape shown by a broken line after the passage. The diameter of the pressure roller becomes large by the thermal expansion, but the external shape is not changed since there is no temperature difference between the center portion and the end portion of the pressure roller in the longitudinal direction. Therefore, if a thin large size recording material passes through the pressure roller in this state, neither paper crease nor image defect is generated.

(2) Relationship Between Temperature Difference Between Center and End Portion of Pressure Roller and Paper Crease and Image Defect at the Time of Passage of Thin Paper Next, experiments were conducted with respect to a relationship between the temperature difference between the center portion (the passing portion) and the end portion (the non passing portion) of the pressure roller 42 and generation of a paper crease and/or an image defect at the time of passage of thin paper. In the present experiments, the fixing apparatus 40 according to the first exemplary embodiment was used. As for the operation conditions, a belt rotation speed was 248 mm/s, a total pressing force was 314 N (32 kgf), and the target temperature of the belt was 180° C.

The evaluation method is described below. First, 150 sheets of A4 size recording materials of CS-680 (manufactured by Nippon Paper Industries Co., Ltd., 210 mm *297 mm) as the small size recording material were passed through the fixing apparatus in the direction that its longitudinal direction was 210 mm (the A4 vertical size). Then, thin large size recording materials were passed through the fixing apparatus immediately after the finish of the passage. As the large size recording material, an A3 size sheet of an "OK prince high quality" 52.3 gsm sheet (manufactured by Oji Paper Co., Ltd., 297 mm*420 mm) was used, and five sheets were passed through the fixing apparatus in the direction that its longitudinal direction was 297 mm (the A4 horizontal size).

It was confirmed whether there was any paper crease or image defect is generated on the five OK prince high quality sheets as the large size recording material when a temperature of the end portion (the non passing portion) of the pressure roller at the time of passage of the CS-680 sheets as the small size recording material was changed.

Next, the energization state of the heater 44 is described below. In the present experiments, 80 W of power was applied to each of the second and fourth individual heat generating members 44*b*-2 and 44*b*-4, and 400 W of power was applied to the third individual heat generating member 44*b*-3 when the above-described small size recording materials (the A4 vertical size) were passed through the fixing apparatus.

To the first and fifth individual heat generating members 44*b*-1 and 44*b*-5 corresponding to the non passing portion, 0 W (no power applied), 10 W, 20 W, 30 W, 40 W, 50 W, and 60 W of power were individually applied. The results are indicated in Table 5.

TABLE 5

| Input power to the individual heat generating member corresponding to the non sheet passing portion | (Center portion temperature) - (end portion temperature) of the pressure roller | Result of passing of sheets |
|---|---|---|
| 0 W (No power applied) | +70° C. | paper creases on 5/5 |
| 10 W | +45° C. | paper creases on 3/5 |
| 20 W | +20° C. | No paper crease and image defect |
| 30 | −5° C. | No paper crease and image defect |
| 36 W | −20° C. | No paper crease and image defect |
| 40 W | −30° C. | Image defect on 1/5 |
| 50 W | −55° C. | Image defect on 4/5 |
| 60 W | −80° C. | Image defect on 5/5 |

It can be confirmed that paper creases were generated when a temperature difference, namely (the center portion temperature)−(the end portion temperature) in the longitudinal direction of the pressure roller 42, exceeded +20° C., and image defects were generated when the temperature difference exceeded −20° C. Therefore, it can be confirmed that generation of the paper crease and the image defect can be prevented by causing (the center portion temperature)−(the end portion temperature) of the pressure roller 42 to fall within ±20° C. Thus, it is desirable for the first and fifth individual heat generating members 44*b*-1 and 44*b*-5 corresponding to non passing portion of the heater 44 to be supplied with about 30 W of power.

More specifically, when recording materials having a smaller width than a recording material having the maximum width are continuously introduced into and heated by the fixing apparatus, the control unit 24 controls the power amount to be applied to the individual heat generating member corresponding to the non passing portion so as to maintain a temperature of a portion corresponding to the non passing portion of the pressure roller 42 of a predetermined third temperature. The third temperature approximately corresponds to a temperature of a portion corresponding to the passing portion of the pressure roller 42. Alternatively, a difference between the third temperature and the temperature of the portion corresponding to the passing portion of the pressure roller 42 falls within a range of ±20° C.

(3) Switching Size of Recording Material and Heating Control of Heater

Figure 11A:
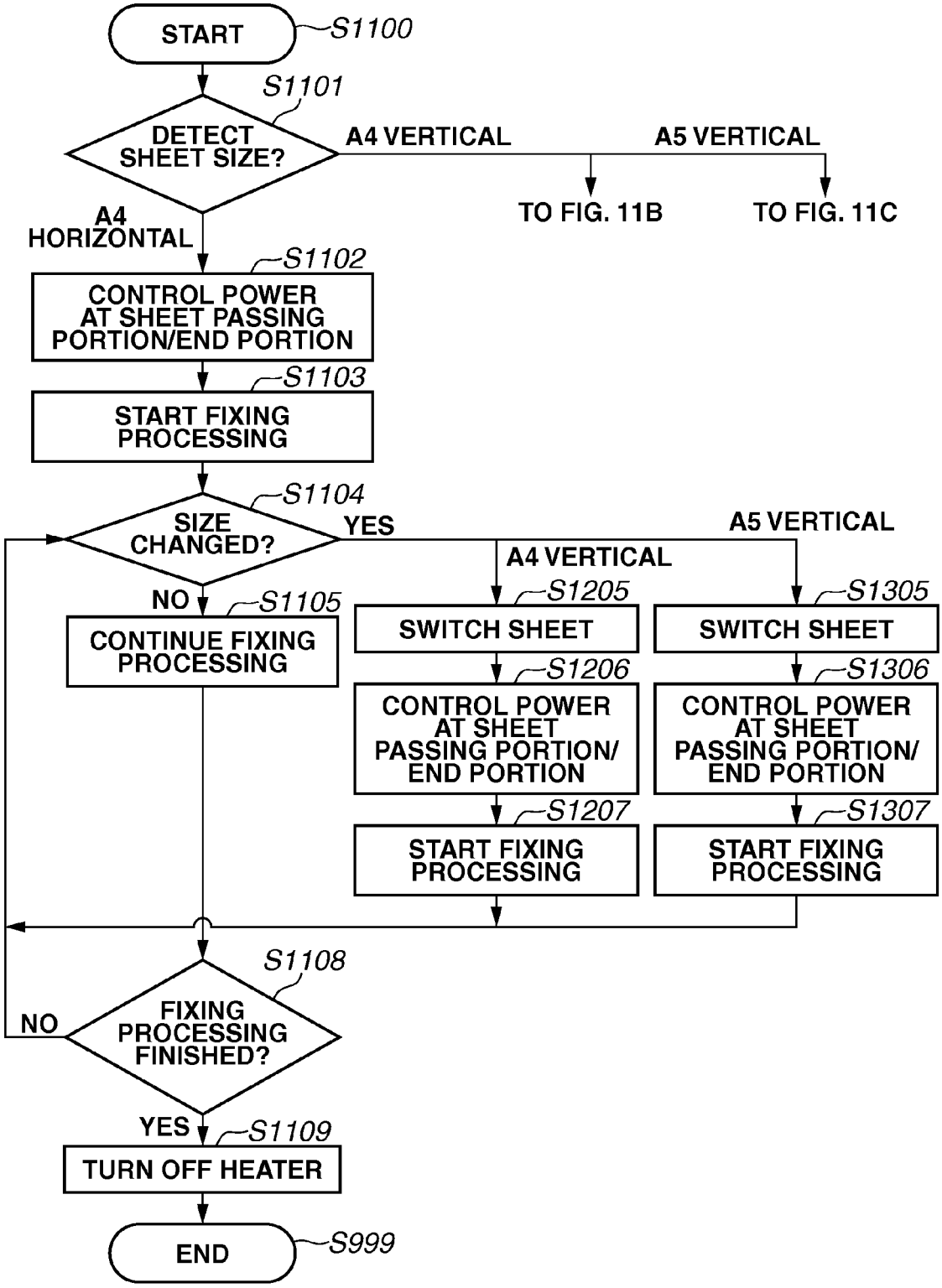
FIG. 11A is a control flowchart (No. 1) of the fixing apparatus according to the second exemplary embodiment.
Figure 11B:
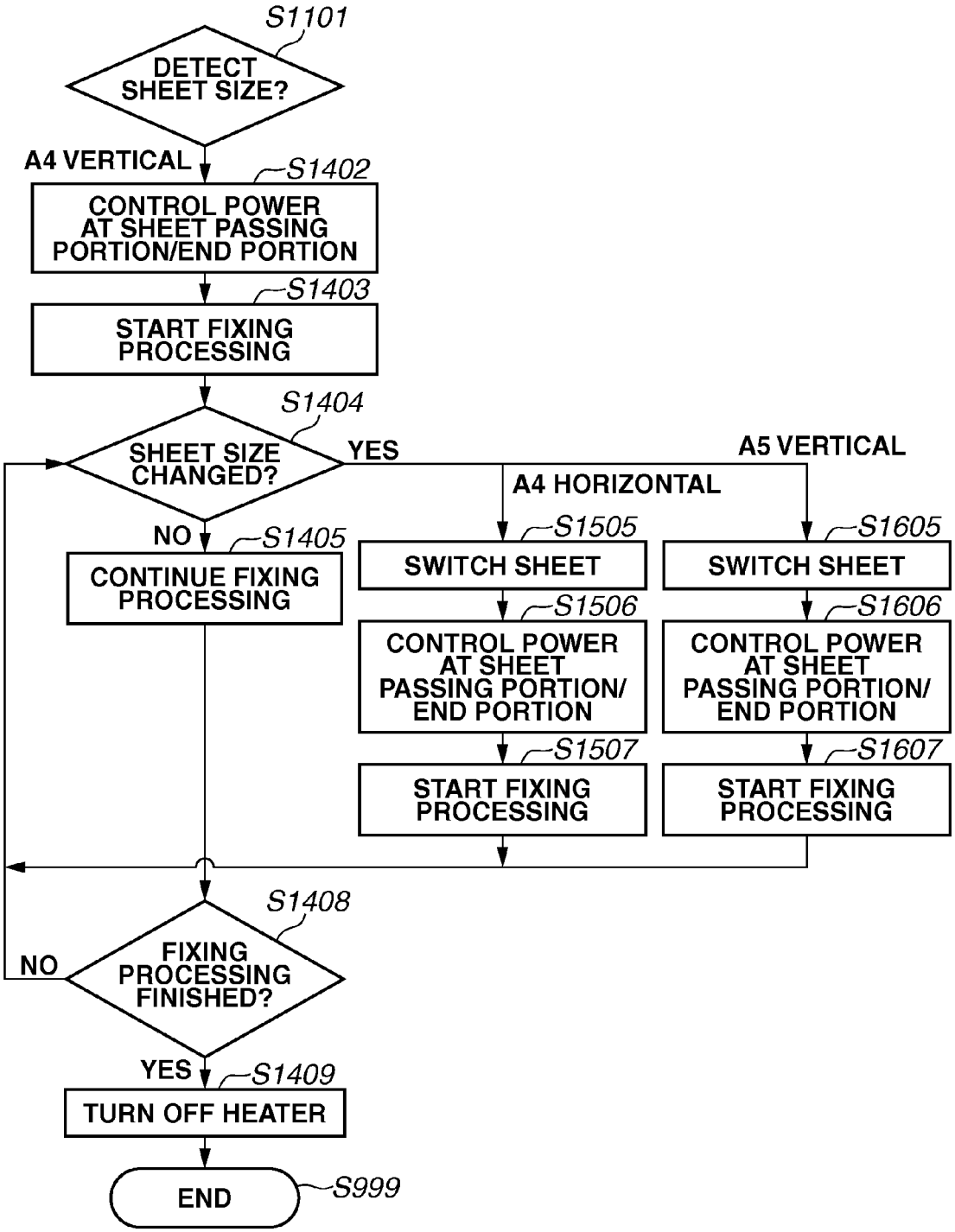
FIG. 11B is a control flowchart (No. 2) of the fixing apparatus according to the second exemplary embodiment.
Figure 11C:
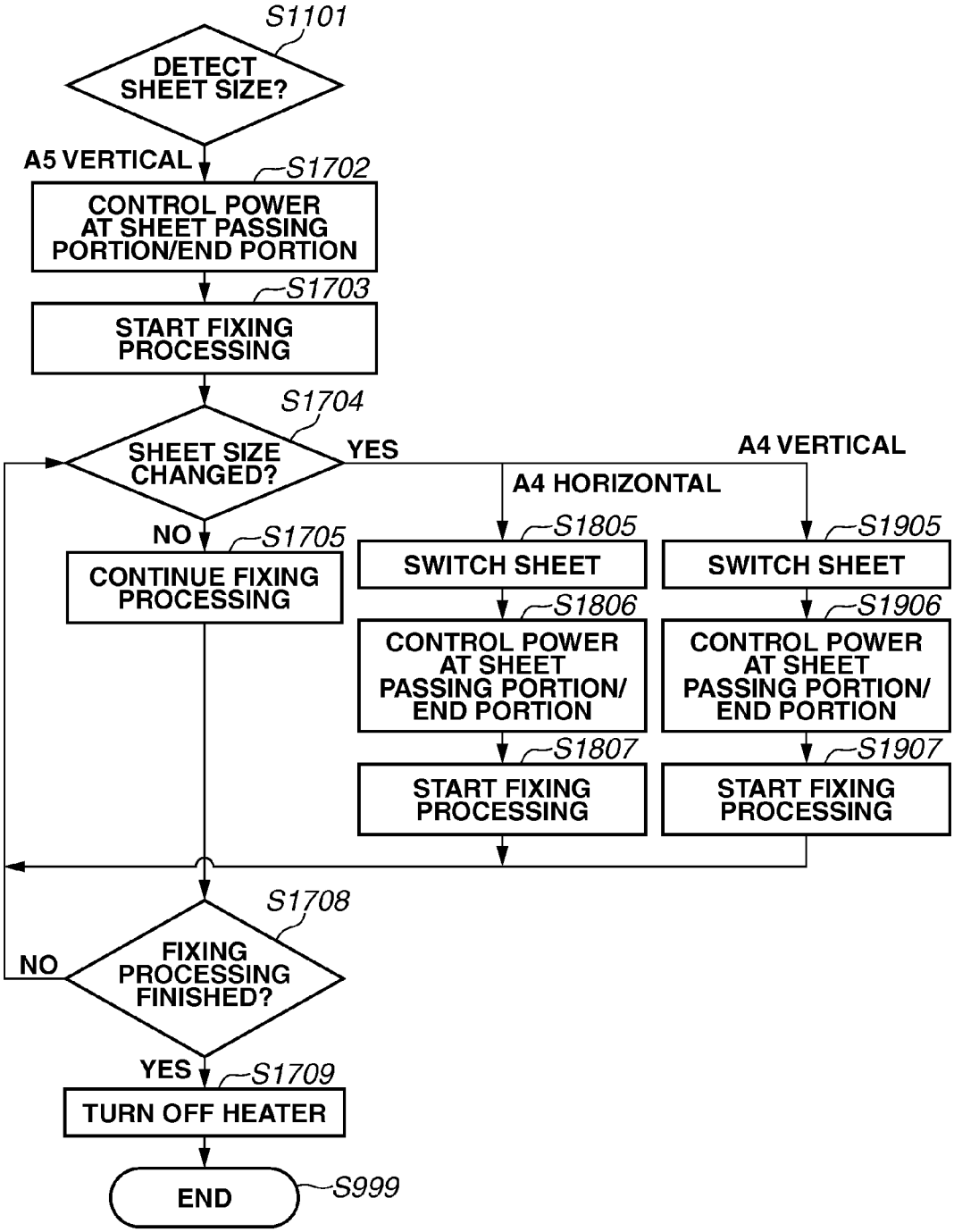
FIG. 11C is a control flowchart (No. 3) of the fixing apparatus according to the second exemplary embodiment.

FIGS. 11A, 11B, and 11C are flowcharts illustrating the operation control of the fixing apparatus including switching of a size of a recording material and heating control of the heater according to the second exemplary embodiment. Each step in the flowchart is described below. The operation control of the fixing apparatus is executed by the control unit 24.

In step S1100: An image formation operation of the image forming unit 2 is started based on an image formation start signal.

In step S1101: A width size of a recording material to be used is detected. The detection of the width size of a recording material is similar to the contents described in step S102 in FIG. 8A according to the first exemplary embodiment. Further, according to the second exemplary embodiment, widths of recording materials which can be used in the fixing apparatus by switching sizes are also three types, namely the A4 horizontal size (297 mm wide), the A4 vertical size (210 mm wide), and the A5 vertical size (148 mm wide).

In step S1101, when the detected size of the recording material to be used is the A4 horizontal size, the processing proceeds to step S1102. Whereas, when the detected size of the recording material is the A4 vertical size, the processing proceeds to the flowchart in FIG. 11B, and when it is the A5 vertical size, the processing proceeds to the flowchart in FIG. 11C.

In step S1102: When the detected size of the recording material is the A4 horizontal size, the rotational driving of the pressure roller 42 is started at a predetermined control timing with respect to the fixing apparatus 40. In addition, the energization to all of the first to fifth individual heat generating members 44*b*-1 to 44*b*-5 is started (turn ON the heater at the entire area in the longitudinal direction) to raise a temperature of the entire length area of the maximum heating area width A of the heater 44 up to 180° C.

According to the second exemplary embodiment, 400 W of power is applied to the third individual heat generating member 44*b*-3 in the center portion in the longitudinal direction. 120 W of power is applied to each of the first and fifth individual heat generating members 44*b*-1 and 44*b*-5, and 80 W of power is applied to each of the second and fourth individual heat generating members 44*b*-2 and 44*b*-4. In addition, the power supply to each of the individual heat generating members is separately controlled by the temperature control system including the first to fifth thermistors TH1 to TH5 so that a temperature of the heater portion (the belt portion) corresponding to each of the individual heat generating members is raised to and maintained of 180° C.

In step S1103: The passing and the fixing processing of the recording material having the A4 horizontal size are started in the control state of the fixing apparatus 40.

In step S1104: Switching of the size of the recording material during the operation of the image forming apparatus is monitored. When the recording material size continues to be the A4 horizontal size (NO in step S1104), the processing proceeds to step S1105. Whereas, when the recording material is switched to a recording material having the A4 vertical size (YES in step S1104), the processing proceeds to step S1205. Further, when the recording material is switched to a recording material having the A5 vertical size (YES in step S1104), the processing proceeds to step S1305.

In step S1105: When the recording material size continues to be the A4 vertical size, the passing and the fixing processing of the recording material are continued.

In step S1108: The passing and the fixing processing for a predetermined set number of sheets are finished.

In step S1109: The energization to all layers of the first to fifth individual heat generating members 44*b*-1 to 44*b*-5 is stopped (turn OFF the heater) at a predetermined control timing, and the driving of the pressure roller 42 is also stopped.

In step S999: The image forming apparatus 1 is maintained in the standby state until a start signal of a next image formation job is input.

In step S1205: As monitored in step S1104, the size of the recording material is switched to the A4 vertical size.

In step S1206: Regarding the power supply to the heater 44, 400 W of power is applied to the third individual heat generating member 44*b*-3, 80 W of power is applied to each of the second and fourth individual heat generating members 44*b*-2 and 44*b*-4, and 30 W of power is applied to each of the first and fifth individual heat generating members 44*b*-1 and 44*b*-5.

In addition, the power supply to the individual heat generating members 44*b*-2 to 44*b*-4 is separately controlled by the temperature control system including the thermistors TH2 to TH4 so that the temperature of the heater portion (the belt portion) corresponding to the passing portion is raised to and maintained of 180° C. The power supply to the individual heat generating members 44*b*-1 and 44*b*-5 corresponding to the non passing portion is reduced from 120 W to 30 W, so that the temperature rise can be suppressed in the heater portion (the belt portion) corresponding to the non passing portion and the pressure roller portion.

In step S1207: The passing and the fixing processing of the recording material having the A4 vertical size are started in the control state of the fixing apparatus 40.

In steps S1104, S1105, S1108, S1109, and S999: The passing and the fixing processing for a predetermined set number of the A4 vertical size recording materials are finished. The energization to all layers of the first to fifth individual heat generating members 44*b*-1 to 44*b*-5 is stopped (turn OFF the heater) at a predetermined control timing, and the driving of the pressure roller 42 is also stopped. The image forming apparatus 1 is maintained in the standby state until a start signal of a next image formation job is input.

In step S1305: As monitored in step S1104, the size of the recording material is switched to the A5 vertical size.

In step S1306: Regarding the power supply to the heater 44, 400 W of power is applied to the third individual heat generating member 44*b*-3 corresponding to the passing portion. Low power of 30 W is applied to each of the first, second, fourth, and fifth individual heat generating members 44*b*-1, 44*b*-2, 44*b*-4, and 44*b*-5 corresponding to the non passing portion.

In addition, the power supply to the third individual heat generating member 44*b*-3 is controlled by the temperature control system including the thermistor TH3 so that the temperature of the heater portion (the belt portion) corresponding to the passing portion is raised to and maintained of 180° C. The power supply to the individual heat generating members 44*b*-1, 44*b*-2, 44*b*-4, and 44*b*-5 corresponding to the non passing portion is set at low power of 30 W, so that the temperature rise can be suppressed in the heater portion (the belt portion) corresponding to the non passing portion and the pressure roller portion.

In step S1307: The passing and the fixing processing of the recording material having the A5 vertical size are started in the control state of the fixing apparatus 40.

In steps S1104, S1105, S1108, S1109, and S999: The passing and the fixing processing for a predetermined set number of the A5 vertical size recording materials are finished. The energization to all layers of the first to fifth individual heat generating members 44*b*-1 to 44*b*-5 is stopped (turn OFF the heater) at a predetermined control timing, and the driving of the pressure roller 42 is also stopped. The image forming apparatus 1 is maintained in the standby state until a start signal of a next image formation job is input.

In step S1101: Referring to FIG. 11B, when the detected size of the recording material is the A4 vertical size in step S1101 in FIG. 11A, the processing proceeds to step S1402.

In step S1402: When the detected size of the recording material is the A4 vertical size, the rotational driving of the pressure roller 42 is started at a predetermined control timing with respect to the fixing apparatus 40. Regarding the power supply to the heater 44, 400 W of power is applied to the third individual heat generating member 44*b*-3, 80 W of power is applied to each of the second and fourth individual heat generating members 44*b*-2 and 44*b*-4, and 30 W of power is applied to each of the first and fifth individual heat generating members 44*b*-1 and 44*b*-5.

In addition, the power supply to the individual heat generating members 44*b*-2 to 44*b*-4 is separately controlled by the temperature control system including the thermistors TH2 to TH4 so that the temperature of the heater portion (the belt portion) corresponding to the passing portion is raised to and maintained of 180° C. The power supply to the individual heat generating members 44*b*-1 and 44*b*-5 corresponding to the non passing portion is set at low power of 30 W, so that the temperature rise can be suppressed in the heater portion (the belt portion) corresponding to the non passing portion and the pressure roller portion.

In step S1403: The passing and the fixing processing of the recording material having the A4 vertical size are started in the control state of the fixing apparatus 40.

In step S1404: Switching of the size of the recording material during the operation of the image forming apparatus is monitored. When the recording material size continues to be the A4 vertical size (NO in step S1404), the processing proceeds to step S1405. When the recording material size is switched to the A4 horizontal size (YES in step S1404), the processing proceeds to step S1505. When the recording material size is switched to the A5 vertical size (YES in step S1404), the processing proceeds to step S1605.

In step S1405: When the recording material size continues to be the A4 vertical size, the passing and the fixing processing of the recording material are continued.

In step S1408: The passing and the fixing processing for a predetermined set number of sheets are finished.

In step S1409: The energization to all layers of the first to fifth individual heat generating members 44*b*-1 to 44*b*-5 is stopped (turn OFF the heater) at a predetermined control timing, and the driving of the pressure roller 42 is also stopped.

In step S999: The image forming apparatus 1 is maintained in the standby state until a start signal of a next image formation job is input.

In step S1505: As monitored in step S1404, the size of the recording material is switched to the A4 horizontal size.

In step S1506: Regarding the power supply to the heater 44, the energization to all of the first to fifth individual heat generating members 44*b*-1 to 44*b*-5 is started (turn ON the heater at the entire area in the longitudinal direction) to raise a temperature of the entire length area of the maximum heating area width A of the heater 44 up to 180° C.

According to the second exemplary embodiment, 400 W of power is applied to the third individual heat generating member 44*b*-3 in the center portion in the longitudinal direction. 120 W of power is applied to each of the first and fifth individual heat generating members 44*b*-1 and 44*b*-5, and 80 W of power is applied to each of the second and fourth individual heat generating members 44*b*-2 and 44*b*-4. In addition, the power supply to each of the individual heat generating members is separately controlled by the temperature control system including the first to fifth thermistors TH1 to TH5 so that the temperature of the heater portion (the belt portion) corresponding to each of the individual heat generating members is raised to and maintained of 180° C.

In step S1507: The passing and the fixing processing of the recording material having the A4 horizontal size are started in the control state of the fixing apparatus 40.

In steps S1404, S1405, S1408, S1409 and S999: The passing and the fixing processing for a predetermined set number of sheets are finished. The energization to all layers of the first to fifth individual heat generating members 44*b*-1 to 44*b*-5 is stopped (turn OFF the heater) at a predetermined control timing, and the driving of the pressure roller 42 is also stopped. The image forming apparatus 1 is maintained in the standby state until a start signal of a next image formation job is input.

In step S1605: As monitored in step S1404, the size of the recording material is switched to the A5 vertical size.

In step S1606: Regarding the power supply to the heater 44, 400 W of power is applied to the third individual heat generating member 44*b*-3 corresponding to the passing portion. Low power of 30 W is applied to each of the first, second, fourth, and fifth individual heat generating members 44*b*-1, 44*b*-2, 44*b*-4, and 44*b*-5 corresponding to the non passing portion.

In addition, the power supply to the third individual heat generating member 44*b*-3 is controlled by the temperature control system including the thermistor TH3 so that the temperature of the heater portion (the belt portion) corresponding to the passing portion is raised to and maintained of 180° C. The power supply to the individual heat generating members 44*b*-1, 44*b*-2, 44*b*-4, and 44*b*-5 corresponding to the non passing portion is set at low power of 30 W, so that the temperature rise can be suppressed in the heater portion (the belt portion) corresponding to the non passing portion and the pressure roller portion.

In step S1607: The passing and the fixing processing of the recording material having the A5 vertical size are started in the control state of the fixing apparatus 40.

In steps S1404, S1405, S1408, S1409 and S999: The passing and the fixing processing for a predetermined set number of sheets are finished. The energization to all layers of the first to fifth individual heat generating members 44*b*-1 to 44*b*-5 is stopped (turn OFF the heater) at a predetermined control timing, and the driving of the pressure roller 42 is also stopped. The image forming apparatus 1 is maintained in the standby state until a start signal of a next image formation job is input.

In step S1101: Referring to FIG. 11C, when the detected size of the recording material is the A5 vertical size in step S1101 in FIG. 11A, the processing proceeds to step S1702.

In step S1702: When the detected size of the recording material is the A5 vertical size, the rotational driving of the pressure roller 42 is started at a predetermined control timing with respect to the fixing apparatus 40. 400 W of power is applied to the third individual heat generating member 44*b*-3 corresponding to the passing portion, and low power of 30 W is applied to each of the first, second, fourth, and fifth individual heat generating members 44*b*-1, 44*b*-2, 44*b*-4, and 44*b*-5 corresponding to the non passing portion.

In addition, the power supply to the third individual heat generating member 44*b*-3 is controlled by the temperature control system including the thermistor TH3 so that the temperature of the heater portion (the belt portion) corresponding to the passing portion is raised to and maintained of 180° C. The power supply to the individual heat generating members 44*b*-1, 44*b*-2, 44*b*-4, and 44*b*-5 corresponding to the non passing portion is set at low power of 30 W, so that the temperature rise can be suppressed in the heater portion (the belt portion) corresponding to the non passing portion and the pressure roller portion.

In step S1703: The passing and the fixing processing of the recording material having the A5 vertical size are started in the control state of the fixing apparatus 40.

In step S1704: Switching of the size of the recording material during the operation of the image forming apparatus is monitored. When the recording material size continues to be the A5 vertical size (NO in step S1704), the processing proceeds to step S1705. When the recording material size is switched to the A4 horizontal size (YES in step S1704), the processing proceeds to step S1805. When the recording material size is switched to the A4 vertical size (YES in step S1704), the processing proceeds to step S1905.

In step S1705: When the recording material size continues to be the A5 vertical size, the passing and the fixing processing of the recording material are continued.

In step S1708: The passing and the fixing processing for a predetermined set number of the recording materials are finished.

In step S1709: The energization to all layers of the first to fifth individual heat generating members 44*b*-1 to 44*b*-5 is stopped (turn OFF the heater) at a predetermined control timing, and the driving of the pressure roller 42 is also stopped.

In step S999: The image forming apparatus 1 is maintained in the standby state until a start signal of a next image formation job is input.

In step S1805: As monitored in step S1704, the size of the recording material is switched to the A4 horizontal size.

In step S1806: Regarding the power supply to the heater 44, the energization to all of the first to fifth individual heat generating members 44*b*-1 to 44*b*-5 is started (turn ON the heater at the entire area in the longitudinal direction) to raise a temperature of the entire length area of the maximum heating area width A of the heater 44 up to 180° C.

According to the second exemplary embodiment, 400 W of power is applied to the third individual heat generating member 44*b*-3 in the center portion in the longitudinal direction. 120 W of power is applied to each of the first and fifth individual heat generating members 44*b*-1 and 44*b*-5, and 80 W of power is applied to each of the second and fourth individual heat generating members 44*b*-2 and 44*b*-4. In addition, the power supply to each of the individual heat generating members is separately controlled by the temperature control system including the first to fifth thermistors TH1 to TH5 so that the temperature of the heater portion (the belt portion) corresponding to each of the individual heat generating members is raised to and maintained of 180° C.

In step S1807: The passing and the fixing processing of the recording material having the A4 horizontal size are started in the control state of the fixing apparatus 40.

In steps S1704, S1705, S1708, S1709 and S999: The passing and the fixing processing for a predetermined set number of sheets are finished. The energization to all layers of the first to fifth individual heat generating members 44*b*-1 to 44*b*-5 is stopped (turn OFF the heater) at a predetermined control timing, and the driving of the pressure roller 42 is also stopped. The image forming apparatus 1 is maintained in the standby state until a start signal of a next image formation job is input.

In step S1905: As monitored in step S1704, the size of the recording material is switched to the A4 vertical size.

In step S1906: Regarding the power supply to the heater 44, 400 W of power is applied to the third individual heat generating member 44*b*-3, 80 W of power is applied to each of the second and fourth individual heat generating members 44*b*-2 and 44*b*-4, and 30 W of power is applied to each of the first and fifth individual heat generating members 44*b*-1 and 44*b*-5.

In addition, the power supply to the individual heat generating members 44*b*-2 to 44*b*-4 is separately controlled by the temperature control system including the thermistors TH2 to TH4 so that the temperature of the heater portion (the belt portion) corresponding to the passing portion is raised to and maintained of 180° C. The power supply to the individual heat generating members 44*b*-1 and 44*b*-5 corresponding to the non passing portion is reduced from 120 W to 30 W, so that the temperature rise can be suppressed in the heater portion (the belt portion) corresponding to the non passing portion and the pressure roller portion.

In step S1907: The passing and the fixing processing of the recording material having the A4 vertical size are started in the control state of the fixing apparatus 40.

In steps S1704, S1705, S1708, S1709 and S999: The passing and the fixing processing for a predetermined set number of sheets are finished. The energization to all layers of the first to fifth individual heat generating members 44*b*-1 to 44*b*-5 is stopped (turn OFF the heater) at a predetermined control timing, and the driving of the pressure roller 42 is also stopped. The image forming apparatus 1 is maintained in the standby state until a start signal of a next image formation job is input.

When recording materials having the A4 vertical size or the A5 vertical size, which are the small size recording materials, are continuously passed through the fixing apparatus over a long period, there is a case that a temperature of the pressure roller end portion (the non passing portion) rises too high. In such a case, the power supply can be turned ON and OFF at a predetermined ratio.

Further, when the maximum size recording material is passed through the fixing apparatus, a temperature of the pressure roller end portion is the same as that of the center portion, so that a temperature of the end portion may rise too high immediately after switching from the maximum size recording material to the small size recording material. In such a case, the power supply to the individual heat generating member corresponding to the non passing portion of the heater 44 can be reduced for a first predetermined time period after switching from the maximum size recording material to the small size recording material.

The above-described control according to the second exemplary embodiment can make a temperature difference, namely "the center portion temperature of the pressure roller−the end portion temperature", fallen within a range of ±20° C. Therefore, the fixing apparatus can prevent generation of paper creases and image defects without setting a waiting time for eliminating the temperature difference between the passing portion and the non passing portion of the pressure roller 42.

(4) Comparison with Comparative Examples

Next, the second exemplary embodiment was compared with comparative examples. As for the operation conditions, a belt rotation speed was 248 mm/s, a total pressing force was 314 N (32 kgf), and the target temperature of the belt was 180° C.

The evaluation method is described below. First, 150 sheets of A4 size recording materials of CS-680 (manufactured by Nippon Paper Industries Co., Ltd., 210 mm *297 mm) as the small size recording material were passed through the fixing apparatus in the direction that its longitudinal direction was 210 mm (the A4 vertical size). When the passage was finished, a time was measured which was required for the temperature difference, i.e. "the center portion temperature (the temperature of the passing portion)−the end portion temperature (the temperature of the non passing portion)" of the pressure roller to fall within a range of ±20° C. This measured time needs to be set as a waiting time in order to prevent generation of a paper crease or an image defect when a thin large size sheet passes through the fixing apparatus.

As for a fixing apparatus according to a first comparative example, the fixing apparatus 40 according to the second exemplary embodiment is used, but the fixing apparatus includes a heater, as the heater 44, of which entire length area of the maximum heating area width A is composed of a single heat generating member.

As for a fixing apparatus of a second comparative example, the fixing apparatus 40 according to the first exemplary embodiment is used, and the fixing apparatus includes a cooling fan which is disposed on the end portion thereof. Further, the fixing apparatus is configured to cool down the belt 43 to a predetermined temperature by the cooling fan when a temperature of the non passing portion rises due to continuous printing of the small size recording materials.

As for a fixing apparatus according to a third comparative example, the fixing apparatus which is provided with a heater including a plurality of individual heat generating members like the second exemplary embodiment is used. Further, the fixing apparatus is configured to perform control not to input power to the individual heat generating member corresponding to the non passing portion in the case of passing of the small size recording material.

Required power amounts and time periods required when a recording material size is changed in the fixing apparatuses according to the second exemplary embodiment and the first to third comparative examples are indicted as below in Table 6.

TABLE 6

| | Required power amounts (Wh) | Required time amount (s) |
|---|---|---|
| Second exemplary embodiment | 13 | 0 |
| First comparative example | 17 | 30 |
| Second comparative example | 19 | 0 |
| Third comparative example | 12 | 25 |

In the case of the first comparative example, the non passing portion is also heated, thus the required power amount increases. In addition, a waiting time for a temperature of the end portion (the non passing portion) of the pressure roller to drop is generated, and the required time amount for changing a size of a recording material is considerably lengthened.

In the case of the second comparative example, the end portion is cooled, thus a temperature of the end portion (the non passing portion) of the pressure roller 42 does not rise. Therefore, there is no required time amount for changing a size of a recording material. However, since the non passing portion is also heated and the heated end portion is cooled, the required power amount increases.

In the case of the third comparative example, the non passing portion is not heated, thus the required power amount is small. However, a waiting time for a temperature of the center portion of the pressure roller to drop is generated, and thus the required time amount for changing a size of a recording material is considerably lengthened.

As described above, according to the second exemplary embodiment, even when a sheet width is changed from the small size recording material to the large size recording material, the fixing apparatus can continue the fixing processing which does not generate a paper crease and an image defect in a low power amount without causing reduction in the productivity due to the down-time or the like.

[Third Exemplary Embodiment]

Next, a third exemplary embodiment according to the present invention is described below. A fixing apparatus according to the third exemplary embodiment has a configuration in which the first to fifth thermistors TH1 to TH5 for controlling temperatures of the respective individual heat generating members 44*b*-1 to 44*b*-5 of the heater 44 are disposed with respect to the pressure roller 42 in the fixing apparatus 40 according to the first and the second exemplary embodiments.

Figure 12:
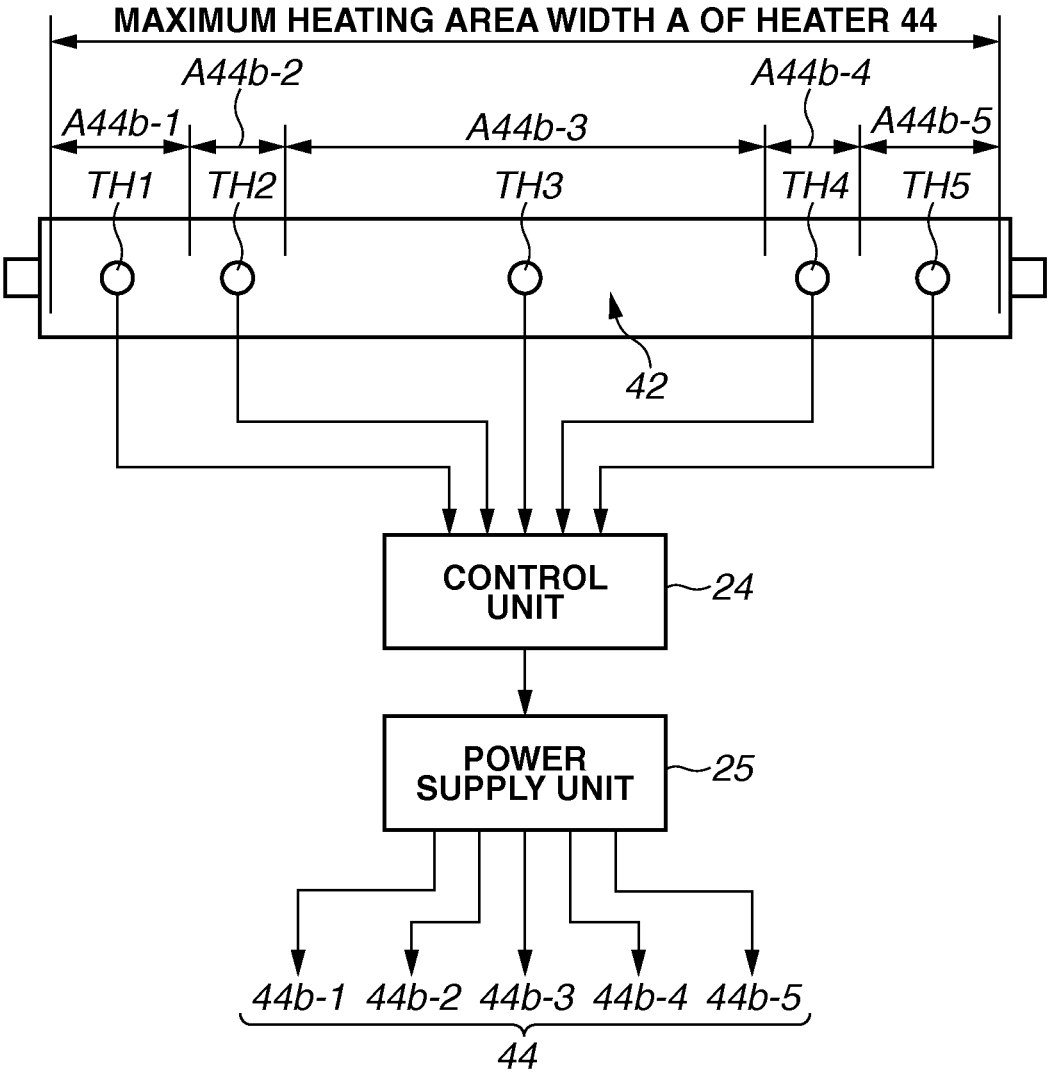
FIG. 12 is a structural drawing illustrating a fixing apparatus according to a third exemplary embodiment.

More specifically, as illustrated in a schematic drawing in FIG. 12, the first to fifth thermistors TH1 to TH5 are respectively disposed on surfaces of roller portions corresponding to heat generation areas A44*b*-1 to A44*b*-5 of the individual heat generating member 44*b*-1 to 44*b*-5 of the heater 44 by abutting thereon. In addition, the fixing apparatus has the configuration in which the thermistors TH1 to TH5 respectively measure temperatures of the roller portions corresponding to the heat generation areas A44*b*-1 to A44*b*-5 of the individual heat generating members 44*b*-1 to 44*b*-5, and feed back the detection results to the temperature control unit of the control unit 24.

The operations of the fixing apparatus 40 are similar to those in the second exemplary embodiment. However, according to the third exemplary embodiment, when a small size recording material passes through the fixing apparatus, a temperature of the non passing portion of the pressure roller 42 is controlled to be approximately same as a temperature of the passing portion. More specifically, the power supply to the individual heat generating member corresponding to the non passing portion when the small size recording material passes through the fixing apparatus is controlled so that a difference between a temperature detected by the thermistor corresponding to the passing portion and a temperature detected by the thermistor corresponding to the non passing portion of the pressure roller 42 becomes almost zero. Therefore, a temperature of the pressure roller 42 is controlled so as to be approximately same over the entire area, namely in the passing portion and in the non passing portion, of the pressure roller 42 when the small size recording material passes through the fixing apparatus.

A temperature of the passing portion of the pressure roller 42 varies according to a type of a recording material (such as contact thermal resistance, thermal conductivity, and thermal capacity), a toner amount for forming an image, the number of sheets to be passed, and the like. In addition, a temperature of the non passing portion also varies according to an environmental temperature, a temperature of the pressure roller at the start of passage of sheets, and so on, even if the input power is the same.

However, according to the third exemplary embodiment, if the conditions such as a type of a recording material and an environmental temperature vary, the pressure roller 42 is controlled so that a temperature of an entire area becomes the same as that of the center portion. Therefore, according to the third exemplary embodiment, even when a sheet width is changed from the small size recording material to the large size recording material, the fixing apparatus can continue the fixing processing which does not generate a paper crease and an image defect in a low power amount without causing reduction in the productivity due to the down-time or the like.

[Fourth Exemplary Embodiment]

Next, a fourth exemplary embodiment according to the present invention is described below. According to the fourth exemplary embodiment, the fixing apparatus 40 which is the same one in the second or the third exemplary embodiment is used. In addition, a control mode of the fixing apparatus 40 described in the second exemplary embodiment is regarded as a first control mode. More specifically, when a small size recording material is used, power supply to the individual heat generating member positioned at an area corresponding to the non passing portion of the heater 44 is controlled so that a difference between a temperature of a portion corresponding to the passing portion and a temperature of a portion corresponding to the non passing portion of the pressure roller 42 falls within a range of ±20° C. This control mode is regarded as the first control mode.

Further, a second control mode is a control mode of the third comparative example in which the non passing portion is not heated in the second exemplary embodiment, more specifically, a control mode which performs control not to input power to the individual heat generating member corresponding to the non passing portion when the small size recording material is used.

According to the fourth exemplary embodiment, a user can select either one of the above-described first control mode and second control mode. Regarding the selection of the first control mode or the second control mode, a user can input a selection instruction to the control unit 24 in advance by operating a mode selection portion provided to an operation unit of the host apparatus 23 or the operation unit 27 of the image forming apparatus (FIG. 1).

In the second control mode, a waiting time is generated but a required power amount can be reduced. Therefore, a user who wants to reduce the power amount to improve power saving performance can select the second control mode in which the non passing portion is not heated, and a user who focuses on the productivity can select the first control mode described in the second exemplary embodiment. In addition, the control made can be switched between the time of printing and the time of copying.

[Other Items]

1) The heat rotatable member 43 can take a form of a roller member. Further, the heat rotatable member 43 can take a form of an endless belt which is suspended and stretched around a plurality of suspension members to be rotationally driven.

2) The fixing apparatus can take a configuration in which the heat rotatable member 43 is externally heated by the heating member 44.

3) The pressing rotatable member 42 can take a form of an endless belt.

4) The heating member 44 can take a configuration which generates heat by electromagnetic induction of each of the individual heat generating members, a configuration which generates heat by a nichrome wire, and a configuration which generates heat using a halogen heater and/or an infrared lamp.

5) The fixing apparatus can take a configuration in which conveyance of a recording material P is performed by single side reference.

6) The image heating apparatus according to the present invention includes an apparatus which heats an unfixed toner image (a developer image) and fixes or temporarily fixes it as a fixed image and an apparatus which reforms a surface nature, such as gloss, of the fixed toner image by re-heating.

7) The image forming unit of the image forming apparatus is not limited to an electrophotographic method type. The image forming unit employing an electrostatic recording method or a magnetic recording method can be used. Further, not limited to the transfer method, a configuration which directly forms a toner image on a recording material can be employed.

8) According to the above-described exemplary embodiments, the fixing apparatus 40 may be implemented by an image forming apparatus, a color copying machine, a facsimile, a color printer, and a multifunction peripheral of these apparatus other than the electrophotographic printer described in the exemplary embodiments. In other words, the fixing apparatus and the electrophotographic printer described in the exemplary embodiments are not limited to combinations of the above-described components and can be implemented by another embodiment in which the components are partially or entirely replaced with substitutes thereof.

9) According to the above-described exemplary embodiments, when fixing processing is performed on a small size recording material after fixing processing of a large size recording material, the operations of the fixing apparatus described in the exemplary embodiments do not need to be performed.

10) According to the above-described exemplary embodiments, ON and OFF operations of the heating source can be performed intermittently.

11) According to the above-described exemplary embodiments, when a user operates the fixing apparatus so as not to perform the operations, the operations described in the exemplary embodiments may not be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-157622, filed Jul. 30, 2013, which is hereby incorporated by reference herein in its entirety.

What is claimed is:

1. An image heating apparatus comprising:

a heat rotatable member configured to heat a toner image on a sheet at a nip portion;

a plurality of heating elements arranged substantially along a longitudinal direction of the heat rotatable member and configured to heat the heat rotatable member;

a controller configured to selectively actuate at least one of the heating elements based on a width of the sheet;

a first sensor configured to detect a temperature of a center region in the longitudinal direction of the heat rotatable member; and a second sensor configured to detect a temperature of an end region in the longitudinal direction of the heat rotatable member, wherein in a case where an image heating operation is performed on a predetermined sheet having a width which is smaller than a maximum width of the sheet usable in the apparatus, the controller actuates at least one of the heating elements which are not in a positional relationship overlapped with the predetermined sheet so that a detection temperature of the second sensor becomes a temperature lower than a detection temperature of the first sensor.

2. The image heating apparatus according to claim 1, wherein, the controller actuates at least one of the heating elements which is not in the positional relationship so that a difference between a detection temperature of the first sensor and a detection temperature of the second sensor falls within 20° C. during the image heating operation.

3. The image heating apparatus according to claim 1, further comprising an elastic roller configured to form the nip portion cooperatively with the heat rotatable member.

4. The image heating apparatus according to claim 3, further comprising a substrate on which the heating elements are disposed, wherein the substrate is arranged so as to nip the heat rotatable member in a gap between the elastic roller.

5. The image heating apparatus according to claim 3, wherein the elastic roller includes a rubber layer.

6. The image heating apparatus according to claim 1, further comprising a substrate on which the heating elements are disposed, wherein the substrate is arranged so as to slide with the heat rotatable member.

7. An image heating apparatus comprising:

a heat rotatable member configured to heat a toner image on a sheet at a nip portion;

a plurality of heating elements arranged substantially along a longitudinal direction of the heat rotatable member and configured to heat the heat rotatable member; and a controller configured to selectively actuate at least one of the heating elements based on a width of the sheet, wherein, in a case where an image heating operation is performed on a sheet having a width which is smaller than a maximum width of the sheet usable in the image heating apparatus, the controller executes a first mode for actuating at least one of the heating elements which are within an area corresponding to a non sheet passing area of the heat rotatable member and are not within an area corresponding to a sheet passing area of the heat rotatable member in a predetermined time period and a second mode for not actuating the heating elements.

8. The image heating apparatus according to claim 7, further comprising a first sensor configured to detect a temperature of a center portion in the longitudinal direction of the heat rotatable member and a second sensor configured to detect a temperature of an end portion in the longitudinal direction of the heat rotatable member, wherein, in a case where an image heating operation is performed on a sheet having a width which is smaller than the maximum width of the sheet in the first mode, the controller actuates at least one of the heating elements so that a detection temperature of the first sensor becomes a first temperature and a detection temperature of the second sensor becomes a second temperature which is lower than the first temperature.

9. The image heating apparatus according to claim 7, further comprising a first sensor configured to detect a temperature of a center portion in the longitudinal direction of the heat rotatable member and a second sensor configured to detect a temperature of an end portion in the longitudinal direction of the heat rotatable member, wherein, in a case where an image heating operation is performed on a sheet having a width which is smaller than the maximum width of the sheet in the first mode, the controller actuates at least one of the heating elements so that a difference between a detection temperature of the first sensor and a detection temperature of the second sensor falls within 20° C.

10. The image heating apparatus according to claim 7, further comprising an elastic roller configured to form the nip portion cooperatively with the heat rotatable member.

11. The image heating apparatus according to claim 10, further comprising a substrate on which the heating elements are disposed, wherein the substrate is arranged so as to nip the heat rotatable member in a gap between the elastic roller.

12. The image heating apparatus according to claim 10, wherein the elastic roller includes a rubber layer.

13. The image heating apparatus according to claim 7, further comprising a substrate on which the heating elements are disposed, wherein the substrate is arranged so as to slide with the heat rotatable member.

* * * * *